US011053067B2

(12) United States Patent
Kashine et al.

(10) Patent No.: US 11,053,067 B2
(45) Date of Patent: Jul. 6, 2021

(54) DISCHARGING NOZZLE FOR FOAMABLE CONTENTS, AND AEROSOL PRODUCT

(71) Applicant: DAIZO CORPORATION, Osaka (JP)

(72) Inventors: Shu Kashine, Ibaraki (JP); Tomoyuki Takahashi, Ibaraki (JP); Erika Matsuho, Ibaraki (JP); Kazuhiro Matsui, Ibaraki (JP)

(73) Assignee: DAIZO CORPORATION, Osaka (JP)

( * ) Notice: Subject to any disclaimer, the term of this patent is extended or adjusted under 35 U.S.C. 154(b) by 0 days.

(21) Appl. No.: 16/768,177

(22) PCT Filed: Nov. 30, 2018

(86) PCT No.: PCT/JP2018/044283

§ 371 (c)(1),
(2) Date: May 29, 2020

(87) PCT Pub. No.: WO2019/111823

PCT Pub. Date: Jun. 13, 2019

(65) Prior Publication Data

US 2020/0290065 A1 Sep. 17, 2020

(30) Foreign Application Priority Data

Dec. 4, 2017 (JP) ..... JP2017-232668
Dec. 6, 2017 (JP) ..... JP2017-234725
Apr. 13, 2018 (JP) ..... JP2018-077767

(51) Int. Cl.
*B05B 7/00* (2006.01)
*B65D 83/28* (2006.01)
*B65D 83/20* (2006.01)

(52) U.S. Cl.
CPC ..... *B65D 83/28* (2013.01); *B65D 83/206* (2013.01)

(58) Field of Classification Search
CPC ..... B65D 83/28; B65D 83/206; B65D 83/14; B65D 83/16; B65D 83/30; B65D 83/205; B05B 9/04

(Continued)

(56) References Cited

U.S. PATENT DOCUMENTS 1,890,441 A * 12/1932 Hickman ..... B65D 47/242 222/521
9,038,866 B2 * 5/2015 Nelson ..... B05C 17/00513 222/568

(Continued)

FOREIGN PATENT DOCUMENTS

JP H06-100062 A 4/1994
JP 7-500553 A 1/1995

(Continued)

OTHER PUBLICATIONS

International Search Report of PCT/JP2018/044283 dated Feb. 26, 2019.

*Primary Examiner* — Donnell A Long
(74) *Attorney, Agent, or Firm* — IP Business Solutions, LLC

(57) ABSTRACT

A discharging nozzle mounted to an aerosol container in which the foamable contents are filled is provided with an inner passage extending in an axial direction of the discharging nozzle, a closing part which closes a top end of the inner passage, and an opening part which opens in a side of the inner passage. Further, an opening inner peripheral surface configuring an opening part is provided with a pair of side surfaces which controls a discharging direction of the foamable contents discharged outside through the opening part from the inner passage.

20 Claims, 21 Drawing Sheets

(58) Field of Classification Search
USPC ..... 222/566
See application file for complete search history.

(56) References Cited

U.S. PATENT DOCUMENTS

| | | | | |
|---|---|---|---|---|
| D848,856 | S * | 5/2019 | Holbrook | D9/688 |
| 2001/0050293 | A1* | 12/2001 | Phinn | B65D 47/242 222/566 |
| 2007/0131804 | A1 | 6/2007 | Westrich | |
| 2010/0091605 | A1* | 4/2010 | Rasmussen | B65D 25/40 366/107 |
| 2011/0198372 | A1* | 8/2011 | White | B67D 7/005 222/482 |
| 2012/0104113 | A1* | 5/2012 | Abfall | B65D 83/75 239/57 |
| 2018/0243763 | A1* | 8/2018 | Eurippini | A45D 34/04 |
| 2019/0047777 | A1 | 2/2019 | Takahashi et al. | |

FOREIGN PATENT DOCUMENTS

| | | | |
|---|---|---|---|
| JP | 3061296 | U | 9/1999 |
| JP | 2016-010919 | A | 1/2016 |
| JP | 2017-007706 | A | 1/2017 |
| JP | 2017-137070 | A | 8/2017 |
| JP | 2017-214147 | A | 12/2017 |
| WO | 93/09057 | A1 | 5/1993 |
| WO | WO2017/131197 | A1 | 8/2017 |

* cited by examiner

DISCHARGING NOZZLE FOR FOAMABLE CONTENTS, AND AEROSOL PRODUCT

CROSS-REFERENCE TO RELATED APPLICATIONS

This is the U.S. National Phase under 35 U.S.C. 371 of International Application No. PCT/JP2018/044283, filed on Nov. 30, 2018, which in turn claims the benefit of Japanese Patent Application Nos. 2017-232668, filed on Dec. 4, 2017, 2017-234725, filed on Dec. 6, 2017, and 2018-077767, filed on Apr. 13, 2018, the disclosures of which are incorporated by reference herein.

BACKGROUND OF THE INVENTION

Field of the Invention

The present invention relates to a discharging nozzle for discharging foamable contents, and an aerosol product using the same. More particularly, it relates to a discharging nozzle for forming a foaming discharged object having a three-dimensional decorativeness, and an aerosol product using the same.

Description of the Related Art

Japanese Patent Application Publication No. 2016-10919 discloses that a plurality of molding holes and a shaping surface in which the molding holes open are provided, and a shaping head forms a molding object by combining a plurality of shaping pieces, which is formed through the plurality of molding holes, on a shaping surface. In Japanese Patent Application Publication No. 2016-10919, for example, the double-petal flower (rose) is formed by discharging foams from the shaping head.

The shaping head disclosed in Japanese Patent Application Publication No. 2016-10919 mainly focuses on a shape of the foam after discharging, and the movement of the foam at the time of discharging is monotonous.

The description herein of advantages and disadvantages of various features, embodiments, methods, and apparatus disclosed in other publications is in no way intended to limit the present invention. For example, certain features of the preferred described embodiments of the invention may be capable of overcoming certain disadvantages and/or providing certain advantages, such as, e.g., disadvantages and/or advantages discussed herein, while retaining some or all of the features, embodiments, methods, and apparatus disclosed therein.

SUMMARY OF THE INVENTION

The disclosed embodiments of the present invention have been developed in view of the above-mentioned and/or other problems in the related art. The disclosed embodiments of the present invention can significantly improve upon existing methods and/or apparatuses.

An object in the present invention is to provide a discharging nozzle which can give a movement to foam at the time of discharging, and provide an aerosol product using the same.

In some embodiments of the present disclosure, a foamable contents discharging nozzle, which is a discharging nozzle mounted on an aerosol container in which the foamable contents are filled, includes an inner passage extending in an axial direction of the discharging nozzle, a closing part

3*b* closing a top end of the inner passage, and an opening part opening in a side of the inner passage. In some embodiments of the present disclosure, the opening inner peripheral surface configuring the opening part is provided with a pair of side surfaces which controls a discharging direction of the foamable contents discharged outside through the opening part from the inner passage.

Further, in some embodiments of the present disclosure, each of the side surfaces is formed in an arc toward outside from the inner passage, and it is preferable that each arc is curved in the same direction. In some embodiments of the present disclosure, among the pair of side surfaces, the curvature degree of the side surface positioned at the outer peripheral side in the curve is larger than the curvature degree of the side surface positioned at the inner peripheral side in the curve.

In some embodiments of the present disclosure, a space between the side surfaces expands outwardly. Further, in some embodiments of the present disclosure, an opening part opens in an elevation angle. Furthermore, in some embodiments of the present disclosure, the opening part is twisted around the axis of a discharge nozzle.

In some embodiments of the present disclosure, the appearance of the discharge nozzle is an approximately conical shape. Further, in some embodiments of the present disclosure, the shape of the opening part is an inverse triangular shape. Further, in some embodiments of the present disclosure, the appearance of the discharge nozzle is an approximately bullet-shape.

In some embodiments of the present disclosure, an aerosol product of the present invention is provided with the aerosol container, the foamable contents which are filled in the aerosol container, and any of the aforementioned discharge nozzles provided in the aerosol container.

The above and/or other aspects, features and/or advantages of various embodiments will be further appreciated in view of the following description in conjunction with the accompanying figures. Various embodiments can include and/or exclude different aspects, features and/or advantages where applicable. In addition, various embodiments can combine one or more aspect or feature of other embodiments where applicable. The descriptions of aspects, features and/or advantages of particular embodiments should not be construed as limiting other embodiments or the claims. In the drawings, the size and relative sizes of layers and regions may be exaggerated for clarity. Like numbers refer to like elements throughout. The terminology used herein is for the purpose of describing particular embodiments only and is not intended to be limiting of the invention. As used herein, the singular forms "a", "an" and "the" are intended to include the plural forms as well, unless the context clearly indicates otherwise. As used herein, the term "and/or" includes any and all combinations of one or more of the associated listed items and may be abbreviated as "/". It will be understood that, although the terms first, second, etc. may be used herein to describe various elements, these elements should not be limited by these terms. Unless indicated otherwise, these terms are only used to distinguish one element from another. For example, a first object could be termed a second object, and, similarly, a second object could be termed a first object without departing from the teachings of the disclosure. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof. It will be understood that when an element is referred to as being "connected" or "coupled" to or "on" another element, it can be directly connected or coupled to or on the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.). However, the term "contact," as used herein refers to direct contact (i.e., touching) unless the context indicates otherwise. Terms such as "same," "planar," or "coplanar," as used herein when referring to orientation, layout, location, shapes, sizes, amounts, or other measures do not necessarily mean an exactly identical orientation, layout, location, shape, size, amount, or other measure, but are intended to encompass nearly identical orientation, layout, location, shapes, sizes, amounts, or other measures within acceptable variations that may occur, for example, due to manufacturing processes. The term "substantially" may be used herein to reflect this meaning. Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and/or the present application, and will not be interpreted in an idealized or overly formal sense unless expressly so defined herein.

DETAILED DESCRIPTION

In the following paragraphs, some embodiments of the invention will be described by way of example and not limitation. It should be understood based on this disclosure that various other modifications can be made by those in the art based on these illustrated embodiments.

Next, an aerosol product 100 of the present invention will be described with reference to the drawings. The aerosol product 100 of the present invention is provided with an aerosol container 110, the foamable contents to be filled in the aerosol container 110, and a discharge member 1 mounted to the aerosol container 110.

Figure 1:
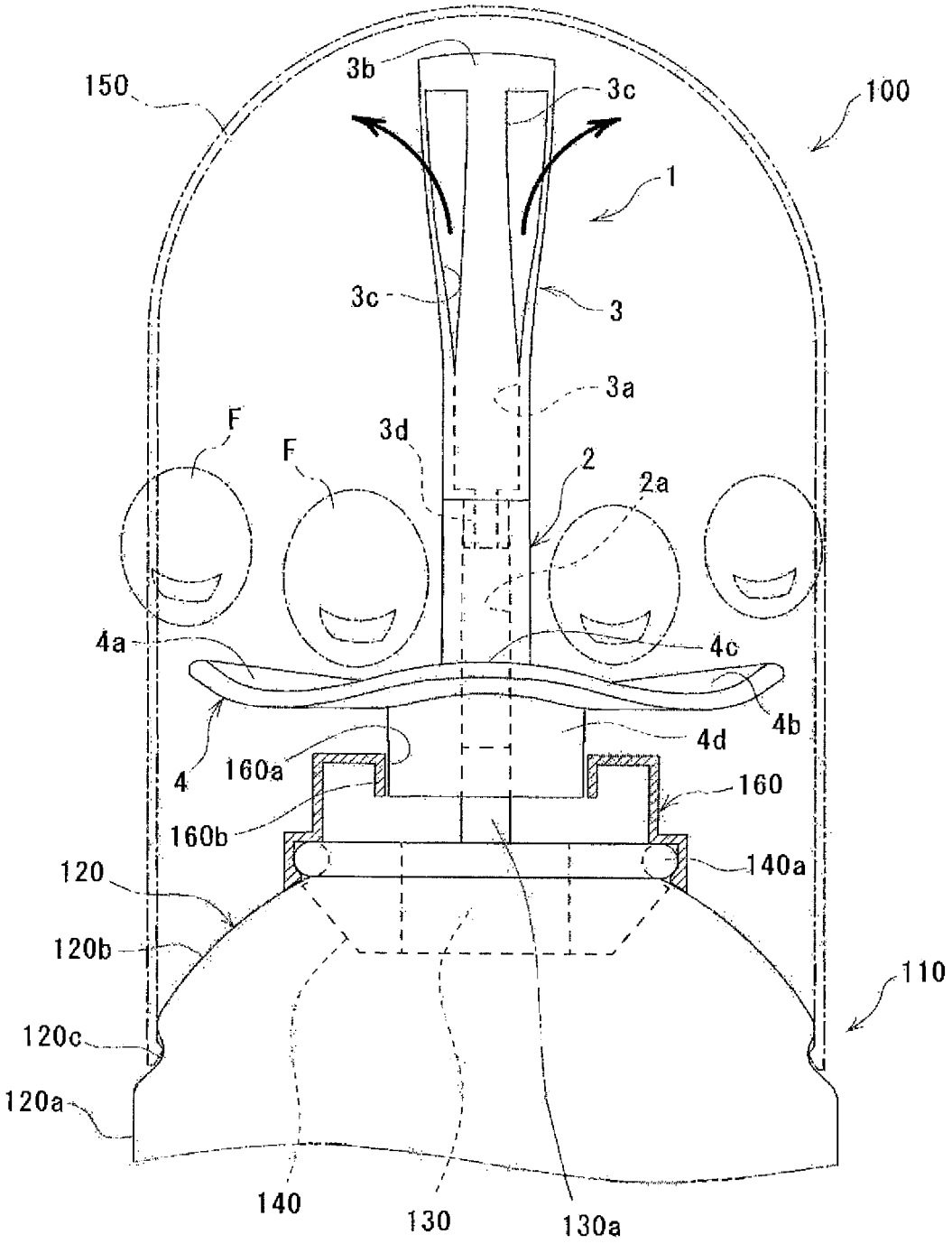
FIG. 1 is a partial cross-sectional view showing an aerosol product of the present invention.

As shown in FIG. 1, it is conventionally known that the aerosol container 110 is provided with a container body 120, an aerosol valve 130 which switches between a communication and non-communication of the inside and the outside of the container body 120, a mounting cup 140 which mounts the aerosol valve 130 to the opening of the container body 120. The container body 120 includes a cylindrical barrel part 120*a*, a shoulder part 120*b* which is gradually reduced in diameter from the upper end of the body portion 120*a* and which is an approximately dome-shape, and a bottom part (not shown) which closes the bottom of the barrel 120*a*. Further, in the container body 120, in a boundary part between the barrel part 120*a* and the shoulder part 120*b*, the groove portion 120*c* which continues in the peripheral direction is provided. Then, in the groove part 120*c*, an approximately dome-shaped cap 150 surrounding the upper end of the aerosol container 110 and the discharge member 1 are detachably mounted. Further, in an annular protrusion part 140*a* which is formed by attaching the mounting cup 140 to the opening of the container body 120, a shoulder cover 160 is mounted. The upper end part of the shoulder cover 160 opens, and a stem 130*a* of the aerosol valve 130 is exposed from the opening 160*a*. When the stem 130*a* is pushed down via the discharge member 1, or when it is tilted to the side, the outside and the inside of the aerosol container 110 communicate each other, and the foamable contents are supplied from the stem 130*a* to the discharge member 1. Note that when the discharging operation is performed by pushing down the discharge member 1 (specifically, an operation part 4 which will be described later), it is preferable to provide a cylindrical guide part 160*b* which extends downwardly from the inner peripheral edge of the opening 160*a* of the shoulder cover 160. The outer circumference of the cylindrical body 4*d* of the operation part 4 which will be described later is surrounded by the guide part 160*b*, so that it is possible to suppress wobbling in the left and right of the operation part 4 at the time of pushing down. With this, it can be pushed down comfortably.

For example, the foamable contents include skin care agents such as face wash, skin detergents, bath agents, moisturizers, cleansing agents, sunscreen agents, lotions, shaving agents, depilatory agents, antiperspirants, sterilizing disinfectants, pest repellents, etc.; human body goods such as hair care agents such as treatment agents, styling agents, hair dyeing agents, etc.; foods such as whipped cream, etc.; household goods such as deodorants, fragrances, insect repellent agents, germicide, etc., and the like. However, it is not limited to these applications.

The foamable contents comprises a concentrate containing active ingredients used as described above, and a propellant in which the concentrate is foamed. The examples of the propellant include 3 to 5 C aliphatic hydrocarbon such as propane, butane, pentane, etc. liquefied gas such as hydrofluoroolefin, dimethyl ether, etc., compressed gas such as carbon dioxide, nitrogen, etc., and the like. Among them, from viewpoints of excellent moldability and shape retainability of a foam, and the easiness of forming a foam in a desired shape, in the concentrate, surfactants such as fatty acid soap, etc., solid oil such as higher alcohol, higher fatty acid, etc. are used, and further, it is preferable to use liquified gas as propellant.

The discharge member 1 is mounted to the stem 130*a*, and the foamable contents and/or the foamed foamable contents (hereinafter, simply referred to as foam) are discharged and molded into a desired shape, and it temporarily holds. The discharge member 1 is provided with a shaft part 2 mounted to the stem 130*a*, a nozzle part (discharge nozzle) 3 connected with the stem 130*a* via the shaft part 2, and an operation part 4 which pushes down or tilts the stem 130*a*.

Figure 2:
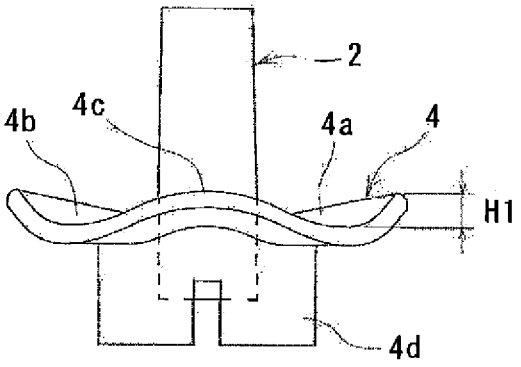
FIG. 2(A) is a front view of an operation unit.
FIG. 2(B) is a plane view of an operation unit.
FIG. 2(C) is a perspective view of an operation unit.
Figure 2:
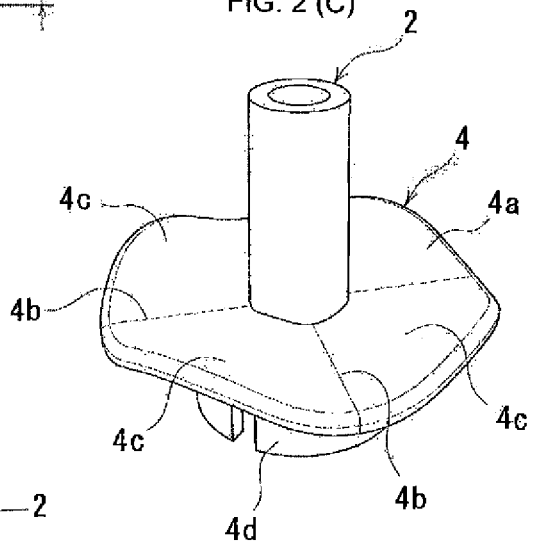
Figure 2:
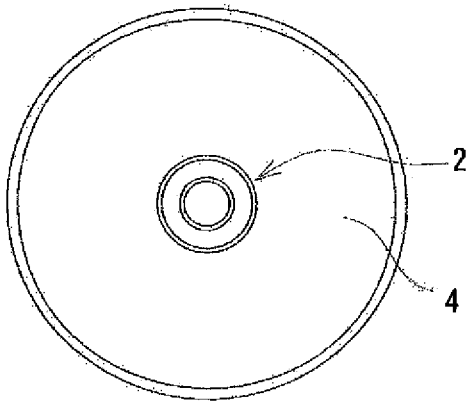

The shaft part 2 is a straw-like shape as shown in FIGS. 1 and 2, and one end in the axial direction (the lower end in the drawings) is mounted to the stem 130*a*, and the nozzle part 3 is mounted to the other end (upper end in the drawings).

As shown in FIG. 1, the appearance of the nozzle part 3 is an approximately conical shape with the diameter increasing from bottom to top. The nozzle part 3 is provided with an inner passage 3*a* extending in the axial direction (vertical direction), a closing part 3*b* which closes the top end of the inner passage 3*a*, and a plurality of discharge outlets (opening parts) 3*c* which opens in the side of the inner passage 3*a*. The inner passage 3*a* is a passage guiding the foam, which is supplied from the aerosol container 110, to the opening parts 3*c*. Therefore, one end (the lower end in the drawings) in the axial direction opens. By inserting the mounting part 3*d* provided in the lower end of the nozzle part 3 into the shaft part 2, the inner passage 3*a* and the communication passage 2*a* of the shaft part 2 communicate with each other. There are four opening parts 3*c* provided at substantially equal intervals around the central axis of the nozzle part 3. The opening parts 3*c* are an elongated inverse triangular shape in the axial direction of the nozzle part 3. However, it is not limited to the inverse triangular shape, and various shapes such as a rectangular shape, elliptic-shape, etc. can be employed. Further, a closing part 3*b* is separately provided, and the cylindrical body, which has a plurality of notches in the peripheral direction, is covered by the closing part 3*b*, so that it is possible to form the opening parts 3*c*. It is preferable to make the nozzle part 3 by using hard materials, for example, a hard-synthetic resin, which is not almost deformed even when receiving a force of human's grip. However, it may be provided with soft materials such as rubber, elastomer, etc. which are easily deformed. When using the soft materials, the foam remained inside the nozzle part 3 can be squeezed out.

As shown in FIG. 2(A), the operation unit 4 extends toward the radially outward direction from the middle part of the shaft part 2 in the axial direction. Then, the surface of the nozzle part 3 side (upper surface: the surface opposite to the aerosol container 110 side) becomes a pushing surface 4*a* for the pressing operation (discharge operation of the contents). That is, at the outer periphery of the nozzle part 3, the operation part 4 has the pushing surface 4*a* positioned at the aerosol container 110 side which is closer than the nozzle unit 3. As shown in FIG. 2(B), the pushing surface 4*a* is an approximately circular shape in a plane view, and it surrounds the periphery of the nozzle part 3 (the shaft part 2). Further, when viewed from the side surface, as shown in FIG. 2(A) or FIG. 2(C), it waves in the peripheral direction around the nozzle part 3 (the shaft part 2). The waviness is provided at equal intervals in the peripheral direction, and in the pushing surface 4*a*, a recess part 4*b* and a protrusion part 4*c* are formed alternately at predetermined intervals. In the operation part 4 shown in FIGS. 1 and 2, the protrusion part 4*c* and the recess part 4*b* are alternately formed at every 45 degrees. When one recess part 4*b* and one protrusion part 4*c* form one waviness, it means that four waviness are provided. Moreover, in the plane view, as the nozzle part 3 is positioned at the center, the recess part 4*b* is positioned at a position rotated 180 degrees from a certain recess part 4*b*, and the protrusion part 4*c* is positioned at a position rotated 180 degrees from a certain protrusion part 4*c*. That is, as the nozzle part 3 is positioned at the center, the recess parts 4*b*, 4*b* and the protrusion parts 4*c*, 4*c* are provided at symmetrical position with each other. The difference from the peak point of the protrusion part 4*c* to the lowest point of the recess part 4*b* (height difference between the recess part 4*b* and the protrusion part 4*c*) H1 is, for example, 3 to 15 mm. From the back side of the pushing surface 4*a* corresponding to the surface (lower surface), the cylindrical body 4*d* extends downwardly in a manner of surrounding the lower end of the shaft part 2. When the discharge operation is performed by pressing the pushing surface 4*a* by hand (it is pushed into the aerosol container 110 side), it functions as a guide so as to smoothly operate the cylindrical body 4*d* in the vertical direction by sliding with the inner peripheral surface of the guide part 160*b* of the shoulder cover 160.

In the aforementioned structure of the aerosol product 100, after removing a cap 150, as shown in a dashed line in FIG. 1, as a manner of positioning the opening part 3*c* of the nozzle part 3 at a palm hand side, or as a manner of positioning the operation part 4 at the back hand side, a hand is inserted between the nozzle part 3 and the operation part 4, and while the shaft part 2 is positioned at the base between fingers F, F (e.g., between middle finger and ring finger), it is assumed that the back of the finger F and the back hand contact to the pushing surface 4*a* of the operation part 4, and the pushing surface 4*a* is pushed arbitrarily by the back of the finger F and the back hand so as to discharge the contents. In the back side of the fingers F, naturally, the fingers F, F have different heights due to the thickness difference of each finger F or joint, etc. However, the recess parts 4*b* or the protrusion parts 4*c* are formed in the pushing surface 4*a*, so that the height difference of the fingers F, F each other can be absorbed or reduced, and even when the back of the fingers F or the back hand is used, the operation part 4 is easily pressed.

Further, in the discharge member 1 of the present invention, after discharging the foam by pressing the operation part 4, by sliding a hand toward the top end side of the nozzle part 3, the foam adhered to the outer periphery of the nozzle part 3 can be wiped off. When the axial direction of the nozzle part 3 is directed upward, the foam can be obtained on the palm of the hand by scooping up from the lower side, so that the shape of the foam is hardly destroyed. For example, in the case of the nozzle part 3 shown in FIG. 1, the foam supplied from the aerosol container 110 proceeds in the axial direction of the nozzle part 3 through the communication passage 2*a* inside the shaft part 2 and the inner passage 3*a* of the nozzle part 3, and the direction is changed to the side by the closing part 3*b*, and the foam is discharged outside from the plurality of the opening parts 3*c* (see the arrows in FIG. 1). In this case, the foam discharged outside through the narrow long opening part 3*c* is irregularly discharged in a wavy manner, so that it is formed as a shape of carnation flower or a shape of cockscomb flower, and without destroying these shapes, it can be moved to the palm of hand side. Specifically, by sliding the hand until the top end of the nozzle part 3 and pulling the hand out upwardly (axial direction of the nozzle part 3), it prevents the foam from being destroyed by the nozzle part 3. Further, while discharging the foam, in a state in which the hand always places at the lower side of the opening part 3*c*, even when the foam is dropped off from the nozzle part 3, it can be surely scooped by the hand.

Next, an operation part, which is different from the operation part 4 as shown in FIGS. 1 and 2, will be described. FIG. 3(A) shows an operation part 41 having three waviness. FIG. 3(B) shows an operation part 42 having five waviness. FIG. 3(C) shows an operation part 43 having six waviness. With this, even when the number of waviness increases or reduces, substantially similar function effect as described in the aforementioned embodiment is obtained. The number of waviness is not particularly limited, but it is preferable to form the recess part 4*b* having at least half of the width of the fingers in the outer peripheral side.

Figure 4:
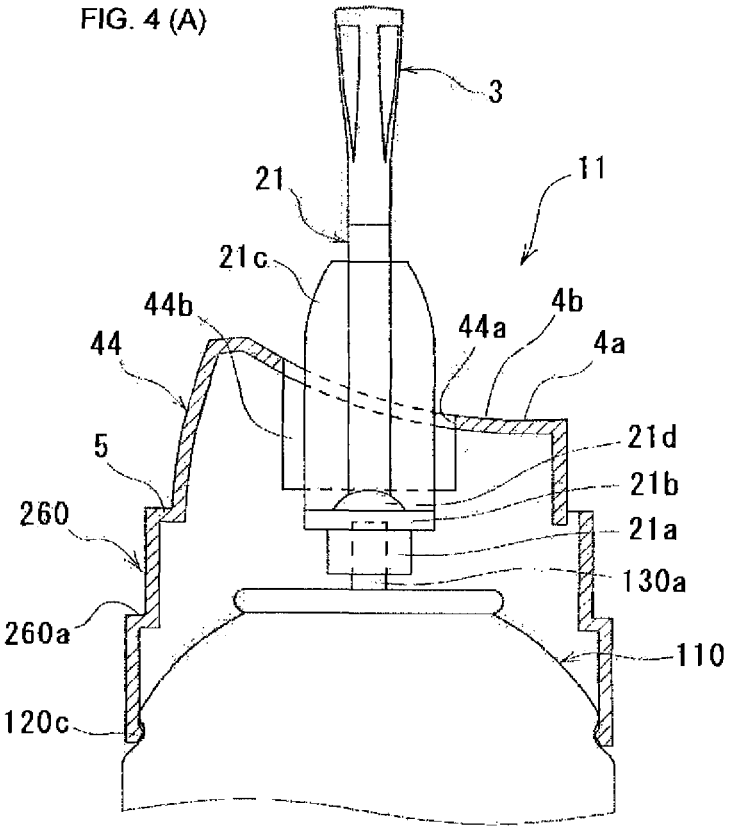
FIG. 4(A) is a partial cross-sectional view showing another discharge member.
FIG. 4(B) is a plane view showing another discharge member in which the nozzle part is omitted.
FIG. 4(C) is a perspective view of the nozzle part and the shaft part.
Figure 4:
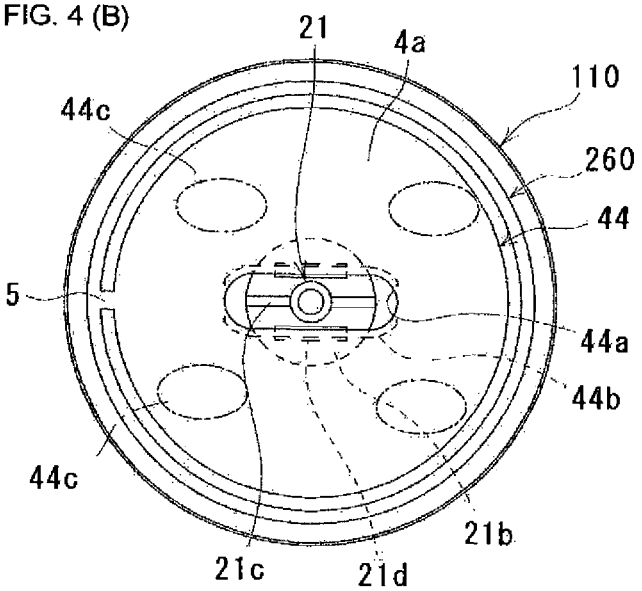
Figure 4:
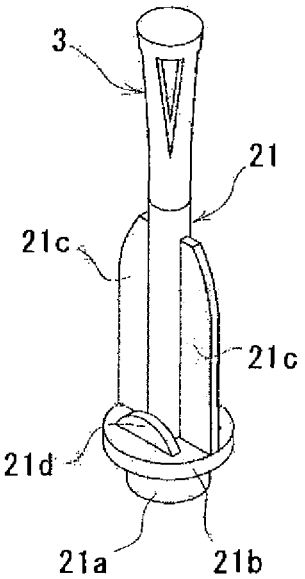

FIG. 4 shows another discharge member 11. In the aforementioned discharge member 1, the shaft part 2, the nozzle part 3, and the operation unit 4 were integrated, but in this discharge member 11, as shown in FIG. 4(A), the operation part 44 is separated from the shaft part 21 and the nozzle part 3. Further, the operation part 44 is connected to a shoulder cover 260 via a hinge 5. The shoulder cover 260 is mounted to the groove part 120*c* of the container body 120. Further, the shoulder cover 260 is provided with a stepped part 260*a* which is formed by reducing the upper part in diameter. The stepped part 260*a* is used for detachably mounting the cap 150 to the shoulder cover 260.

As shown in FIG. 4(A) or 4(C), the lower end of the shaft part 21 becomes a stem mounting part 21*a*, and at the upper side of the stem mounting part 21*a*, a flange part 21*b*, which is an approximately circular shape in the plane view, is provided. Further, on the upper surface of the flange part 21*b*, a rib 21*c* is provided to continue until the upper end of the shaft part 21. The ribs 21*c*, 21*c* are arranged each other to be aligned on a straight line in the plane view. The rib 21*c* functions as a direction guide part to guide in the direction of inserting when a hand is inserted between the nozzle part 3 and the operation part 44. That is, when a hand places on the pushing surface 4*a*, the rib 21*c* has be placed between the fingers, so that the direction of a hand is naturally decided. Further, on the upper surface of the flange part 21*b*, in the plane view, a semicircular-shaped pin supporting point 21*d* is provided in approximately parallel to the rib 21*c*. The pin supporting point 21*d* is used to convert from a pressing force, which is applied from the operation part 44 in which a force apply direction is always changed by rotating around the hinge 5, to a vertical force (force toward the aerosol container 110) so as to transmit it to the stem 130*a*.

As shown in FIG. 4(B), a pushing surface 4*a* positioned on the upper surface of the operation part 44 (nozzle part 3 side) is formed in an approximately circular shape in plane view, but when viewed from the side surface, as shown in FIG. 4(A), it is formed in a shape in which the hinge 5 side is the highest and which is gradually inclined downwardly from the hinge side. Further, as a whole, a large recess part 4*b* is formed in a shape along the back hand which forms a convex surface gradually inclined in a natural state. At the center of the pushing surface 4*a*, an opening 44*a* for penetrating the shaft part 21 is provided. The opening 44*a* is formed in an elliptical shape extending toward the hinge 5. Further, a pushing piece 44*b* for pushing the pin supporting point 21*d* of the shaft part 21 is provided in a manner of extending the inner peripheral surface of the opening 44*a* downwardly. The shaft part 21 is arranged inside the opening 44*a* in a manner of facing one rib 21 toward the hinge 5 side and facing another rib 21*c* toward the side opposite to the hinge 5.

In the aforementioned structure of the discharge member 11, in a state in which the palm of hand faces up (nozzle part 3 side), the hand is inserted between the nozzle part 3 and the operation part 44 from the lower side of the pushing surface 4*a*, and the rib 21*c* or the shaft part 21 is placed between the fingers, and the back of fingers or the back of hand contacts to the pushing surface 4*a*, and arbitrarily, by pressing down the pushing surface 4*a*, the contents can be discharged from the aerosol container 110. Note that in the discharge member 11, the pushing surface 4*a* is pressed by, mainly, the back of hand, so that the discharge operation is easy compared with a case in which it is pressed by the back of fingers. Note that the pushing surface 4*a* may has a shape in which the hinge 5 side is the lowest point and which is gradually inclined upward from the lowest point. That is, it may be a shape reversed from the shape shown in FIG. 4(A). In this case, when operating from a height position with respect to the pushing surface 4*a* such as a state in which, for example, the aerosol product placed on a washstand, etc. is used while standing, etc., it is easy to insert a hand along the pushing surface 4*a*, and it is easy to perform a discharge operation by the back of hand.

Figure 5:
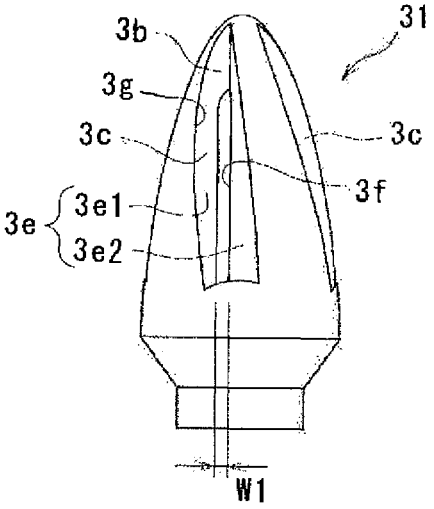
FIG. 5(A) is a front view showing another nozzle part.
FIG. 5(B) is a cross-sectional view showing another nozzle part.
FIG. 5(C) is a plane view showing another nozzle part.
Figure 5:
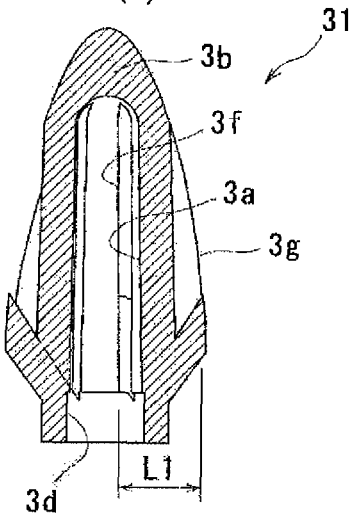
Figure 5:
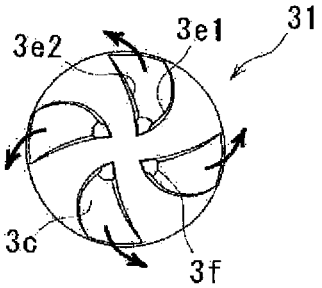

FIG. 5 shows a nozzle part which is different from the nozzle part 3 shown in FIG. 1. In the nozzle part (discharging nozzle) 31, an opening inner peripheral surface 3*e* configuring an opening part 3*c* is provided with a pair of side surfaces 3*e*1, 3*e*2 which controls a discharging direction of the discharging contents discharged outside through the opening part 3*c* from the inner passage 3*a*. Specifically, the nozzle part 31 is thick, and by the pair of side surfaces 3*e*1, 3*e*2 continued from an inlet (a boundary between the opening part 3*c* and the inner passage 3*a*) 3*f* of the opening part 3*c* to an outlet (a boundary between the opening part 3*c* and the outer surface of the nozzle part 31) 3*g*, a control passage, which has enough length enable to control a discharging direction of foam as a discharging object, is formed. For example, the horizontal direction length L1 of the control passage is longer than the horizontal direction width W1 of the inlet 3*f* of the opening part 3*c*. Further, the pair of side surfaces 3*e*1, 3*e*2 is formed in an arc toward the outside from the inner passage 3*a*, and each arc is curved in the same direction. In other words, the control passage is curved.

In a case of the aforementioned structure of the nozzle part 31, the foam is discharged outside through the curved control passage, so as to be discharged while swirling around the axis of the nozzle part 31 (see the arrow shown in FIG. 5(C)). At the same time, it is moved upward by the force of the propellant, so that the foam discharged later is partially overlapped under the foam discharged previously, and a spiral shaped foam (soft cream shape) is obtained. When the spiral shaped foam is discharged, it hardly splashes around, and it is hardly attached and dripped around the nozzle part 31, so that it is easily scooped by the palm of hand.

The present invention is not limited to the aforementioned embodiments, and various modifications may be made within the scope of the present invention. For example, in the discharge member shown in FIGS. 1 to 3, the waviness (recess part 4*b* or protrusion part 4*c*) of the pushing surface 4*a* is provided at equal intervals, but they are not necessarily provided in equal intervals, so that it is possible to provide them irregularly. Further, it is not necessary to be the same width size of the recess part 4*b* and the protrusion part 4*c*, so that the width of the recess part 4*b* may be larger or smaller than the width of the protrusion part 4*c*. Regarding the depth of valleys of the recess part 4*b* or the height of mountains of the protrusion part 4*c*, all of them do not have to be the same, and they may be different from each other. In addition, the pushing surface 4*a* may be a shape along the shape of the back of fingers.

Figure 3:
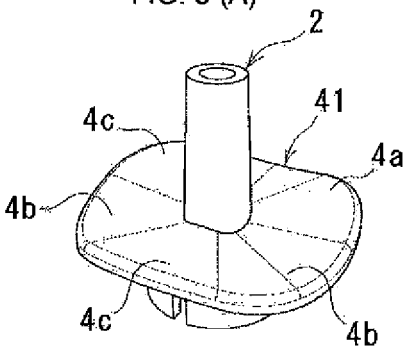
FIG. 3(A) is a perspective view showing another operation part.
FIG. 3(B) is a perspective view showing another operation part.
FIG. 3(C) is a perspective view showing another operation part.
Figure 3:
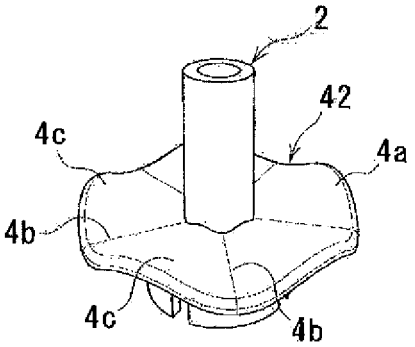
Figure 3:
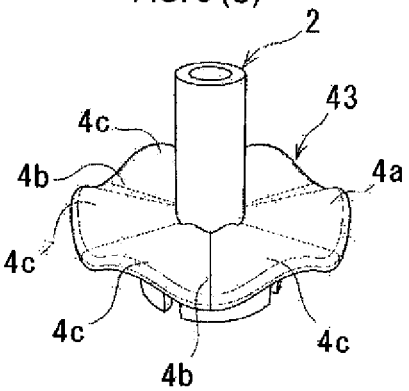

Further, as the direction guide part of the discharge member 11 shown in FIG. 4, it is not limited to the rib 21*c*, and it may be a plate-shaped or a columnar-shaped projection. Further, it may be a recess. For example, as shown in the dashed line of FIG. 4(B), a recess 44*c* is provided at the portion where a finger joint is placed, so that the inserting direction of a hand can be confirmed in advance. Further, the direction guide part may be applied to the discharge member 1 as shown in FIGS. 1 to 3. In this case, it is possible to insert a hand in an ideal angle. Furthermore, the direction guide part may be provided in the nozzle parts 3, 31 or the operation parts 4, 41, 42, 43, 44, the pushing surface 4*a* instead of the shaft parts 2, 21. In addition, in FIG. 1, the aerosol product 100 is provided with the cap 150 or the shoulder cover 160, but they may not be necessarily provided.

Figure 6:
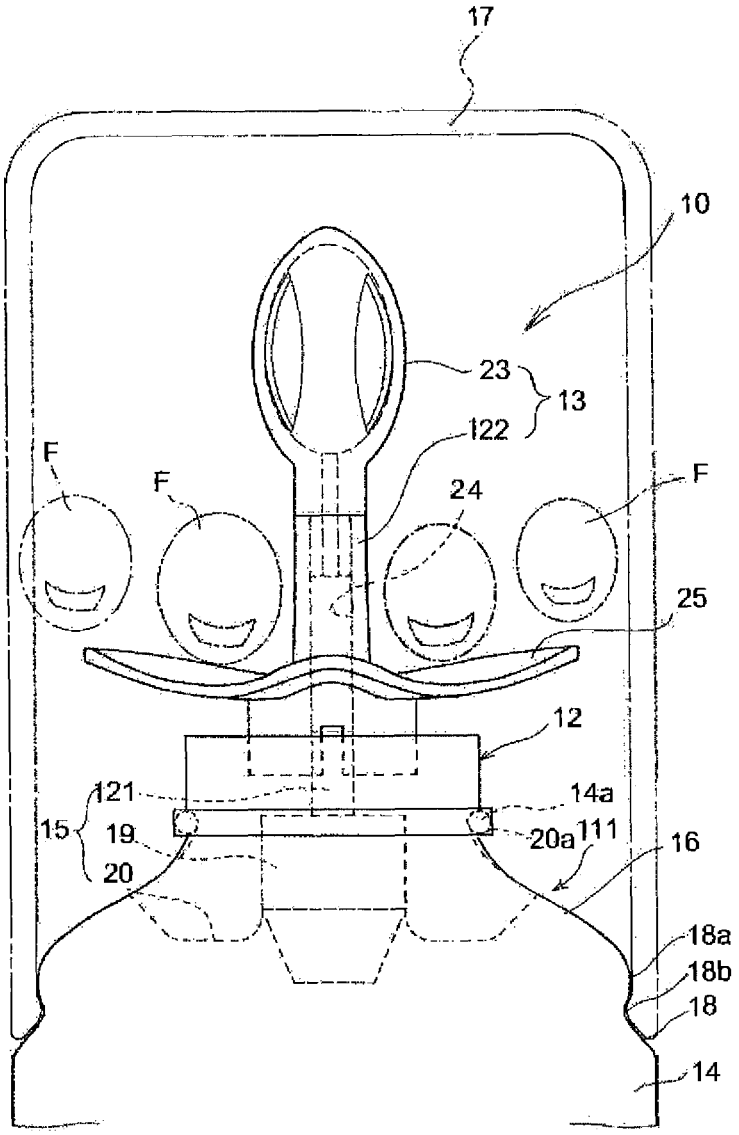
FIG. 6 is a partial front view showing another embodiment of the aerosol product of the present invention.

The aerosol product 10 shown in FIG. 6 is provided with an aerosol container 111 in which the foamable contents are filled, a shoulder cover 12 mounted on the upper end of the aerosol container 111, and the discharge member 13. The aerosol container 111 is provided with a bottomed cylindrical shaped container body 14, and an aerosol valve 15 fixed to the upper end opening of the container body 14. The container body 14 is made of metal or synthetic resin, and in the shoulder part 16, a stepped part 18 is formed so that the over-cap 17 is detachably mounted. In the lower part of the vertical wall 18*a* of the stepped part 18, a locking groove 18*b* for locking the over cap 17 is provided.

The aerosol valve 15 is publicly known to be provided with a valve housing 19, a mounting cap 20 for fixing the valve housing to the opening of the container body 14, a stem 121 which is inserted freely movable up and down to the valve housing and discharges the contents by performing pressing down operation, a spring which energizes the stem upward, a stem rubber which seals the stem hole of the stem, and a gasket which seals between the mounting cap and the container body, etc.

The shoulder cover 12 is mounted to the periphery part 20*a* of the mounting cap 20 which covers the bead part 14*a* of the container body 14, and it is the bottomed cylindrical shaped member having an opening for passing the discharge member 13. The shoulder cover 12 is made of synthetic resin, etc. The shoulder cover 12 is used to hide the aerosol valve 15 and improve the appearance, and it may be omitted. A guide part for guiding the discharge member 13 to move up and down can be provided in the shoulder cover 12. The shoulder cover 12 and the lower part of the discharge member 13 can be connected by a hinge. When the container body 14 is made of synthetic resin, the shoulder cover can be fixed with screws.

Figure 7:
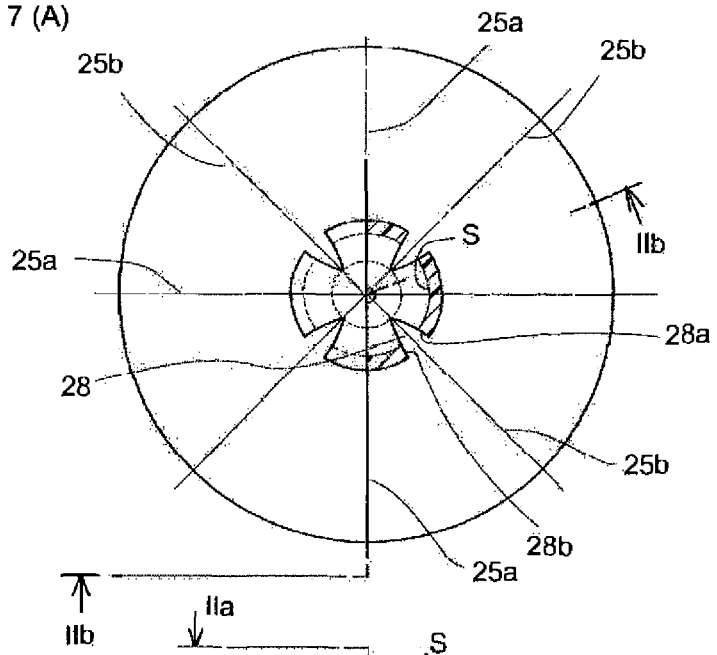
FIG. 7(A) is a partial cross-sectional plane view showing the discharge member in FIG. 6.
FIG. 7(B) is a partial cross-sectional front view showing the discharge member in FIG. 6.
Figure 7:
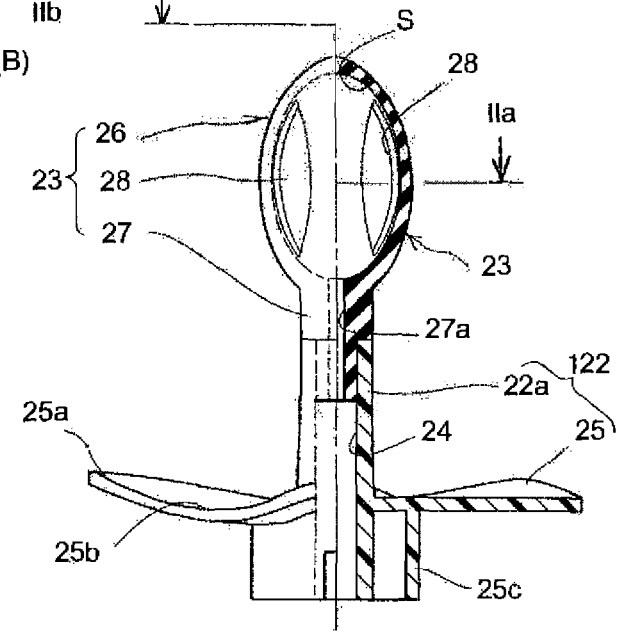

As shown in FIG. 7(B), the discharge member 13 is provided with an operation part 122 on the lower side and a nozzle (discharging nozzle) 23 on the upper side. The right side of the nozzle 23 of FIG. 7(A) shows the cross section by a IIa-IIa line of FIG. 7(B), and the right side of FIG. 7(B) shows a cross-section by a IIb-IIb line. As shown in FIG. 7(B), the operation part 122 has a cylindrical body 22*a* having a passage 24 extending along a center at the inner part, and at the outer periphery of the cylindrical body 22*a*, a pushing piece 25 expanding in the radius direction at the middle of the vertical direction is provided as an operation piece. In addition, at the lower part of the pushing piece 25, the cylindrical base 25*c* surrounding the cylindrical body 22*a* is provided.

The pushing piece 25 is a thin-disk shape with waviness in the peripheral direction, so that the back of user's fingers F is easily fit. For example, approximately 3 to 5 of the wave mountains 25*a* and valleys 25*b* extend radially. The pushing piece 25 can be a flat-disk. The lower end of the passage 24 functions as a fitting hole to fit with the stem 121, and the upper end is a fitting part with the nozzle 23. For the operation part 122, a molding of polyester such as polybutylene terephthalate, etc., polycarbonate such as polyacetal, etc., hard synthetic resin such as nylon, etc. can be used.

As shown in FIG. 7(B), the nozzle 23 is a cylindrical shape in which the upper end is closed entirely. The upper part of the nozzle 23 is a rugby ball shaped discharge part 26 arranged in the vertical direction, and in its inside, a space S for accelerating foam of the contents and holding the foam is formed. The lower part of the nozzle 23 is provided with a cylindrical mounting part 27. A passage (inner passage) 27*a* communicating with the space S is formed inside the mounting part 27 and an opening is formed at its lower end. The lower end outer periphery of the mounting part 27 is made narrow to fit to the upper end of the passage 24 of the operation part 122. On the side surface of the discharge part 26, four discharge ports (opening parts) 28 for communicating between the inside of the space S and the outside are formed at equal intervals in the peripheral direction. It is preferable to provide a plurality of discharge ports 28, for example, 2 to 6 discharge ports, and more preferably, it is 3 to 5 discharge ports. It is preferable to provide the discharge ports in approximately equal intervals in the peripheral direction.

The discharge port 28 is an elongated spindle shape, etc., and the cross section from the space S of the discharge part to the front surface (surface corresponding to the thickness) configures the side walls (side surfaces) 28*a*, 28*b*, and the discharge port 28 is provided in a spindle shape formed by the pair of the side walls 28*a*, 28*b* and opens in an extending manner in the axial direction. In FIG. 7(A), the side walls 28*a*, 28*b* are formed along the surface passing through the center of the nozzle 23, and open radially outward. Further, in the present embodiment, the nozzle 23 as a whole is molded from a crushable elastic material such as rubber, elastomer, etc. As long as it is crushable by fingers and recoverable when removing the external force, it may be molded by synthetic resins such as polyethylene, polylactic acid, etc., having elasticity. It may be possible to provide only the discharge part 26 or a part of the discharge part in an elastic deformable state. In addition, as long as the material is crushable, it is not limited to the elastic material, but in this case, it is recovered to the original shape by inner pressure at the time of next discharge. Further, regarding the operation part 122, it may be made of the same elastic material as the nozzle 23 as long as it does not cause problems in the operation and the production. When using the elastic material, or not using the elastic material, the nozzle 23 and the operation part 122 can be molded integrally.

Figure 8:
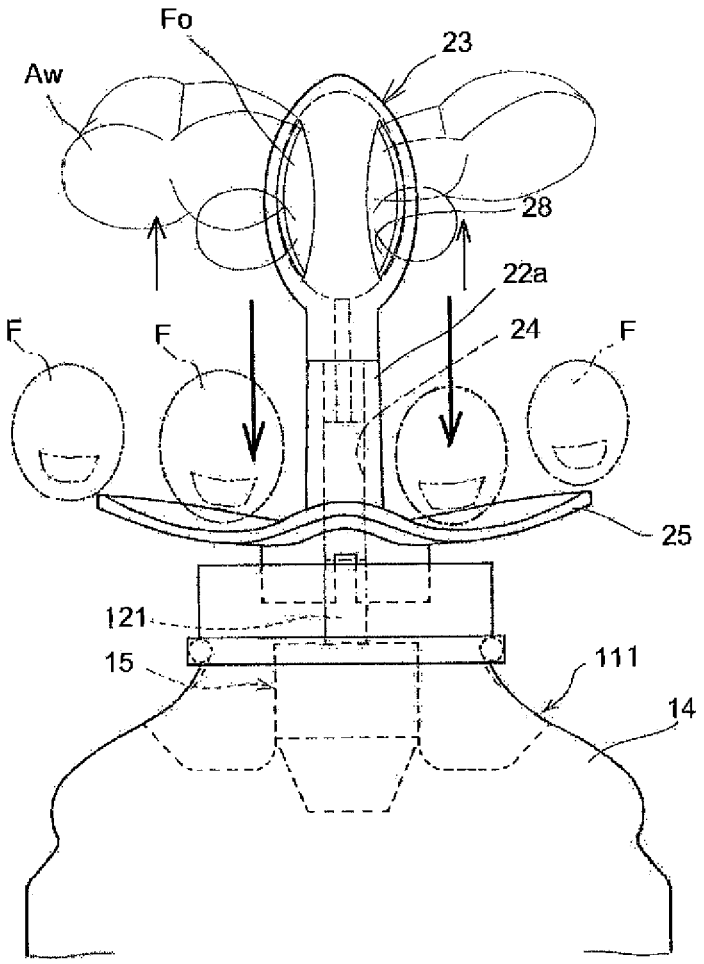
FIG. 8 is a front view showing a use of the aerosol product of FIG. 6.

Next, the method for using the aerosol product 10 configured as described above will described with reference to FIGS. 6 and 8-10. The aerosol product 10 is placed on a table, etc. The user uses the palm of hand upward, and the back of fingers F and the back of hand are placed on the pushing piece 25 while pushing (shown in FIG. 6) in a manner in which the cylindrical body 22*a* or the nozzle 23 of the operation part 122 is sandwiched between, for example, the middle finger and the ringer finger, and pushes it down further as shown in FIG. 8. With this, the stem 121 is pushed down, and the aerosol valve 15 opens, and the foamable contents are discharged from the upper end of the stem 121. Further, the contents go up through the passages 24, 27*a* while being foamed, and enter the space S. The contents are foamed when discharging from the stem 121, or it is foamed inside the space S which is in an atmospheric pressure.

As shown in FIG. 8, the foam Fo inside the space S is discharged from each discharge port 28. At this point, an upward movement of the foam discharged first is suppressed at the upper end of the discharge parts 28, and the foam discharged later is overlapped under the foam discharged previously, so that a three-dimensional foam body Aw of a flower-like such as a carnation flower, etc. is formed in the four directions around the discharge part 26. When a desirable amount of foam is discharged, the user can stop pressing the pushing piece 25. Accordingly, the aerosol valve 15 is closed and the foam stops.

Figure 9:
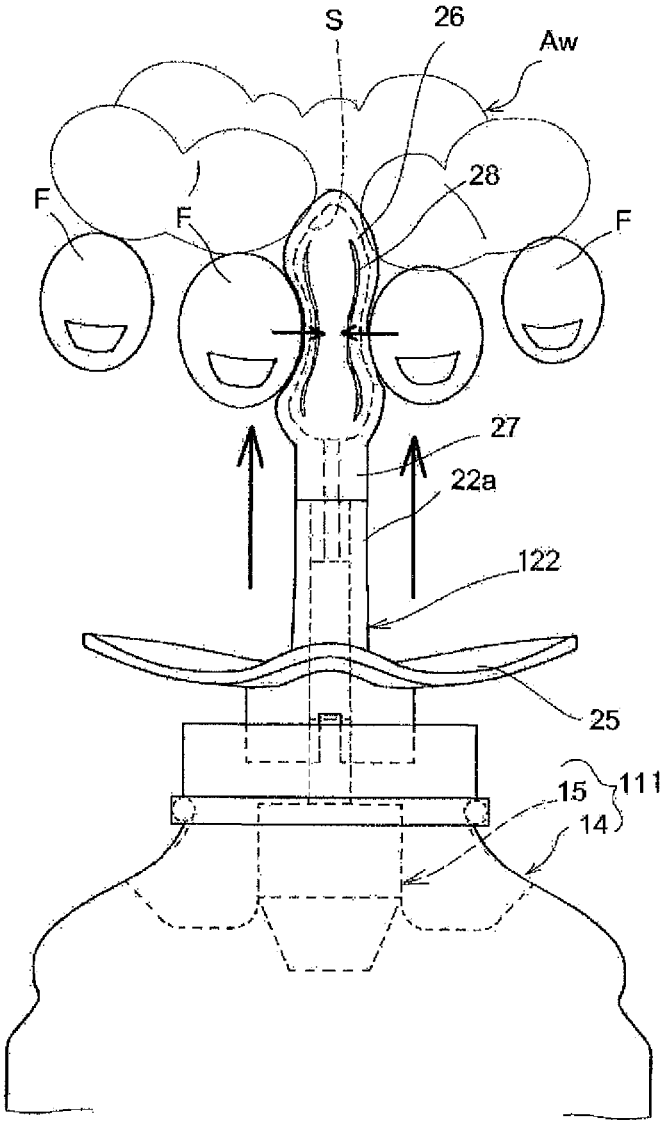
FIG. 9 is a front view showing a use method subsequent to FIG. 8.

As shown in FIG. 9, the user raises the palm of hand, and the foam body Aw is scooped up by the palm of hand. At this time, the discharge part 26 in which the diameter is larger than the mounting part 27 is compressed in accordance with the progress of the fingers. Thus, by squeezing up the discharge part 26 by the user's fingers, the remaining foam can be squeezed to the space S inside the discharge part 26 while moving the foam body to the palm of hand. Therefore, the foam hardly remains inside the nozzle 23 so as to be kept sanitary.

Figure 10:
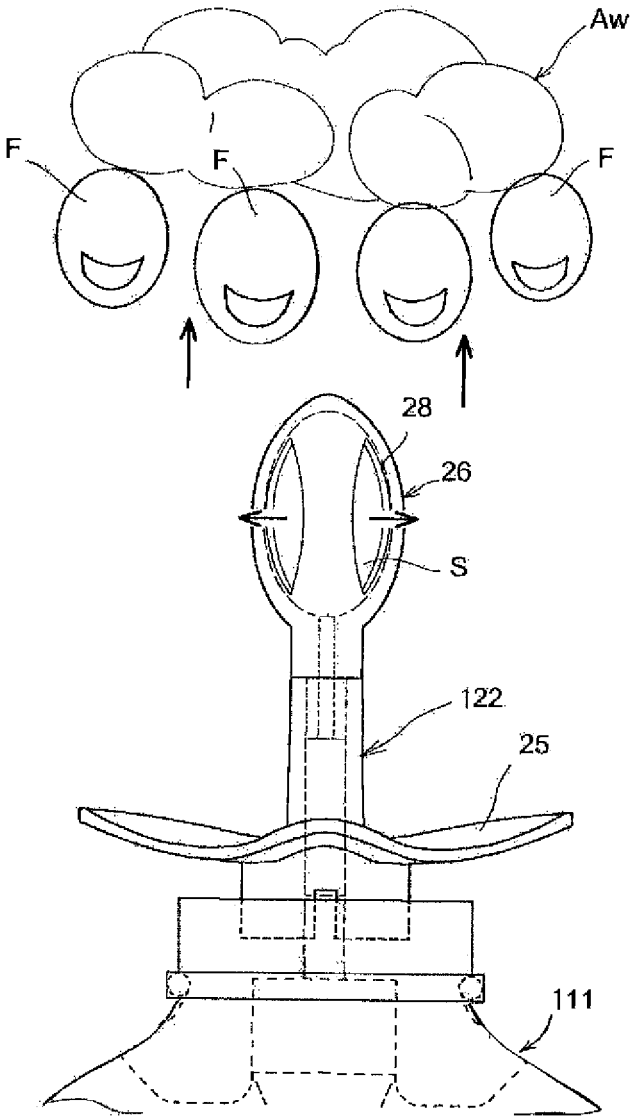
FIG. 10 is a front view showing a use method subsequent to FIG. 9.

When the user's fingers F are released from the nozzle 23, as shown in FIG. 10, almost entire amount of the foam body Aw is moved to the palm of hand. The shape of the discharge part 26 returns to the original rugby ball shape with the elasticity. Then, little amount of the foam Fo remained inside the passage 24, 27*a* is absorbed inside the discharge part 26, and after-draw such that the foam is discharged after use is suppressed. Therefore, it becomes good appearance.

In the aerosol product 10 shown in FIG. 6 as described above, a three-dimensional foam body Aw can be formed around the nozzle. In addition, it can be moved to the palm of hand without destroying the shape, and it has an advantage that the remaining foam inside the nozzle is little so that after-draw hardly occurs.

Figure 11:
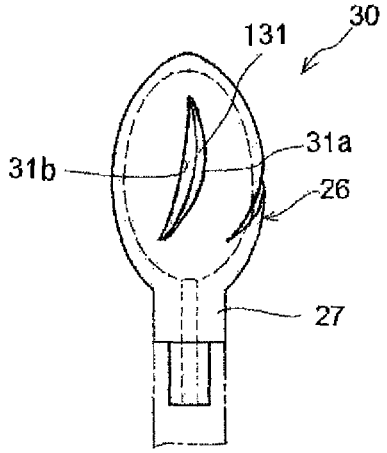
FIG. 11 is a front view showing another embodiment of a nozzle of the present invention.

Next, another embodiment of the nozzle of the present invention will be described with reference to FIG. 11. In the nozzle (discharging nozzle) 30 shown in FIG. 11, a discharge port (opening part) 131 formed in the discharge part 26 is obliquely cut. Accordingly, a pair of side walls (side surface) 31*a*, 31*b* in which the discharge port 131 is formed obliquely extends in the axial direction, the foam discharged from the discharge port 131 is discharged in a swirling manner around the nozzle 30, and a three-dimensional spiral shaped foam body such as soft-cream like is obtained. The user can enjoy looking at how the foam is discharged spirally. Without aligning the inclination or unifying the width size of the discharge port 131, each discharge port may be changed. In addition, the inclination direction may be changed to alternate each other.

Figure 12:
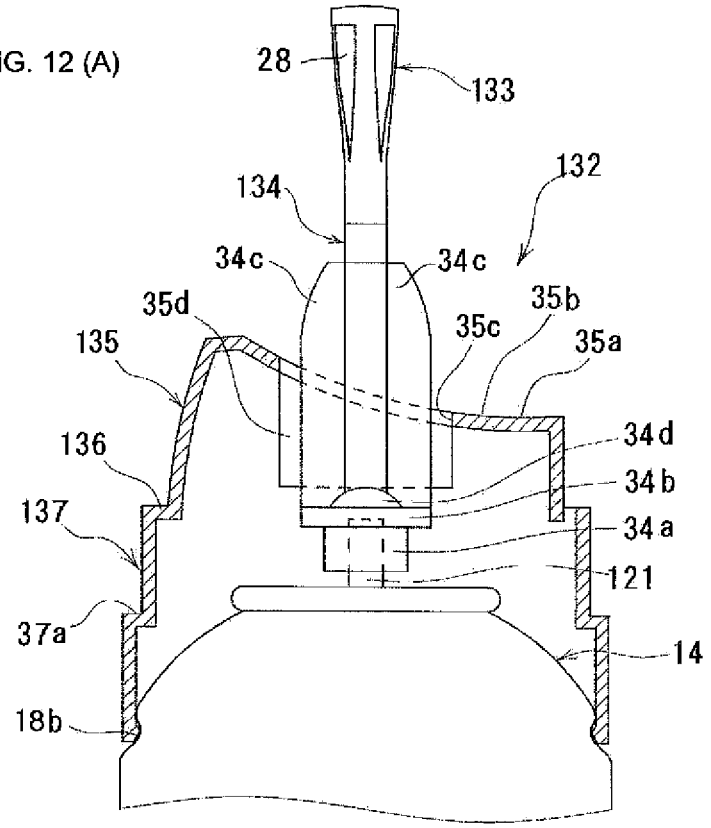
FIG. 12(A) is a cross-sectional view showing another embodiment of a discharge member of the present invention.
FIG. 12(B) is a plane view showing the discharge member.
FIG. 12(C) is a perspective view showing the nozzle and the shaft of the discharge member.
Figure 12:
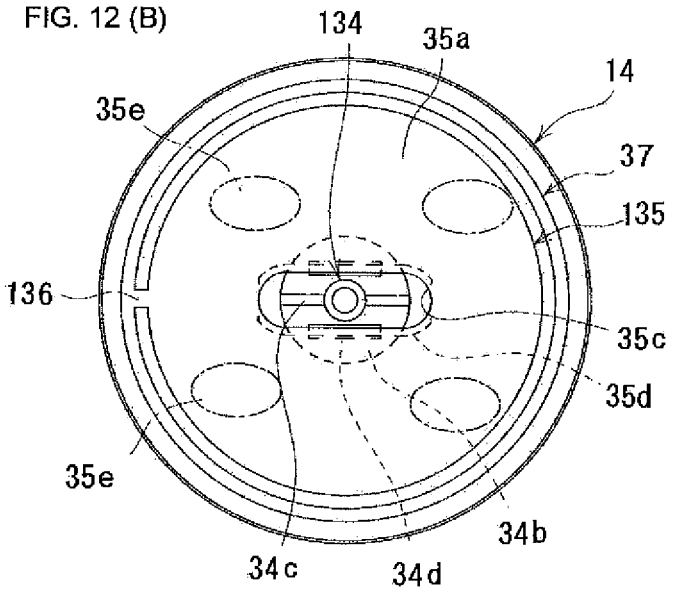
Figure 12:
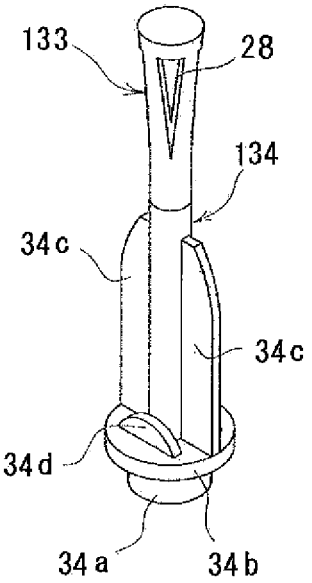

FIG. 12 shows another discharge member 132. The aforementioned discharge member 13 is integrated with a cylindrical body 22*a* and a pushing piece 25 of an operation part 122, but as shown in FIG. 12(A), in the discharge member 132, a shaft part (cylindrical body) 134 holding a nozzle (discharging nozzle) 133 and the pushing part (operation piece) 135 are separated, and the pushing part 135 is connected to the shoulder cover 137 via a hinge 136. The shoulder cover 137 is mounted to the locking groove 18*b* of the container body 14. Further, the shoulder cover 137 is provided with a stepped part 37*a* in which the diameter of the upper part is reduced. The stepped part 37*a* is formed so that the over-cap (see reference numeral 17 shown in FIG. 6) is detachably mounted. Further, the shape of the nozzle 133 is not rugby ball-shape, but it is an inverse conical shape which gradually increases the diameter in an upward direction. The shape of the discharge port 28 is an inverse triangular shape which gradually expands upwardly.

As shown in FIGS. 12(A) and 12(C), the lower end of a shaft part 134 is a stem mounting part 34*a*, but an approximately circular shaped flange part 34*b* in plane view is provided to the upper side of the stem mounting part 34*a*. Further, on the upper surface of the flange part 34*b*, two ribs 34*c* which continue to the upper end of the shaft part 134 are provided. In the plane view, the ribs 34*c*, 34*c* are arranged each other to be aligned on a straight line. These ribs 34*c*, 34*c* function as a direction guide part which guides an inserting direction in order to insert a hand between the nozzle 133 and the pushing part 135. That is, when the hand is placed on the pushing surface 35*a*, the rib 34*c* has to be placed between the fingers, so that the direction of a hand is naturally decided.

Further, on the upper surface of the flange part 34*b*, in the plane view, a semicircular-shaped pin supporting point 34*d* is provided in approximately parallel to the rib 34*c*. The pin supporting point 34*d* is used to convert from a pressing force, which is applied from the pushing part 135 in which a force apply direction is always changed by rotating around the hinge 136, to a vertical force (force toward aerosol container 111) so as to transmit it to the stem 121.

As shown in FIG. 12(B), a pushing surface 35*a* placed on the upper surface (nozzle part 133 side) of the pushing part 135 is formed in an approximately circular shape in the plane view, but when viewed from the side surface, as shown in FIG. 12(A), it is formed in a shape in which the hinge 136 side is the highest and which is gradually inclined downwardly from the hinge side. Further, as a whole, a large recess part 35*b* is formed in a shape along from the back hand to the back fingers which forms a convex surface gradually inclined in a natural state. At the center of the pushing surface 35*a*, an opening 35*c* for penetrating the shaft part 134 is provided. The opening 35*c* is formed in an elliptical shape extending toward the hinge 136. Further, a pushing piece 35*d* for pushing the pin supporting point 34*d* of the shaft part 134 is provided in a manner of extending the inner peripheral surface of the opening 35*c* downward. The shaft part 134 is arranged inside the opening 35*c* in a manner of facing one rib 34*c* toward the hinge 136 side and facing another rib 34*c* toward the side opposite to the hinge 136.

In the aforementioned structure of the discharge member 132, in a state in which the palm of hand faces up (nozzle part 13 side), a hand is inserted between the nozzle part 133 and the pushing part 135 from the lower side of the pushing surface 35*a*, and the rib 34*c* or the shaft part 134 is placed between the fingers, and the back of fingers or the back of hand is contacted with the pushing surface 35*a*, and arbitrarily, by pushing down the pushing part 135, the contents can be discharged from the aerosol container 111. Note that in the discharge member 132, the pushing surface 35*a* is pushed by mainly, the back of hand, so that the discharge operation is easy compared with a case in which it is pushed by the back of fingers.

Note that it is possible that the pushing surface 35*a* has a shape in which the hinge 136 side is the lowest point and which is gradually inclined upward from the lowest point. That is, it may be a shape reversed from the shape shown in FIG. 12(A). In this case, when operating from a height position with respect to the pushing surface 35*a* in a state in which for example, the aerosol product placed on a washstand, etc. is used while standing, etc., it is easy to insert a hand along the pushing surface 35*a*, and it is easy to perform a discharge operation by the back of hand.

Figure 13:
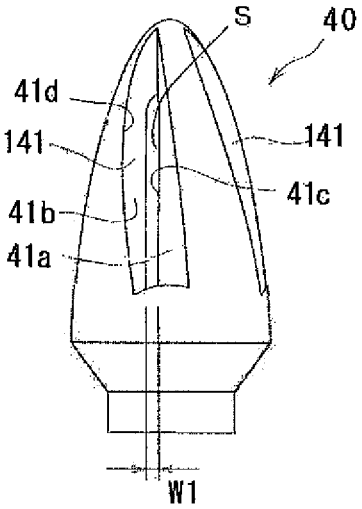
FIG. 13(A) is a front view showing still another embodiment of a nozzle of the present invention.
FIG. 13(B) is a cross-sectional view showing the nozzle.
FIG. 13(C) is a plane view showing the nozzle.
Figure 13:
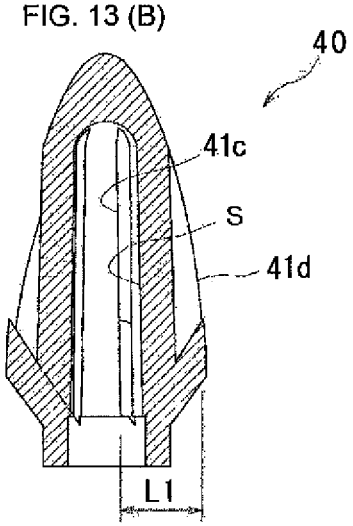
Figure 13:
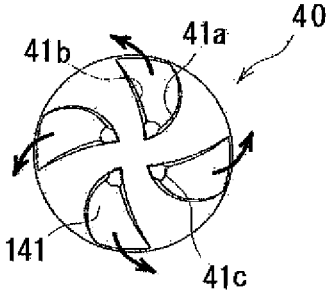

FIG. 13 shows a nozzle which is different from the nozzle 23 shown in FIG. 6. In the nozzle (discharging nozzle) 40, the right and left inner edges of the opening configuring the discharge port (opening part) 141 which is vertically elongated is provided with a pair of side walls (side surfaces) 41*a*, 41*b* which controls a discharging direction of the discharge contents discharged outside through the discharge port 141 from the space S inside the passage. Specifically, the nozzle 40 is thick, and by the pair of side walls 41*a*, 41*b* continued from an inlet (a boundary between the discharge port 141 and the space S) 41*c* of the discharge port 141 to an outlet (a boundary between the discharge port 141 and the outer surface of the nozzle 40) 41*d*, a control passage, which has enough length enable to control a discharging direction of foam which is the discharging object, is formed. For example, the horizontal direction length L1 of the control passage is longer than the horizontal direction width W1 of the inlet 41*c* of the discharge port 141. Further, the pair of side walls 41*a*, 41*b* is formed in an arc toward the outside from the space S, and each arc is curved in the same direction. In other words, the control passage is curved (see FIG. 13(C)). The nozzle 40 is made narrow toward the upper side, so that as shown in the plane view of FIG. 13(C), when the nozzle 40 is viewed from above, the length of the control passage becomes longer as it goes below. Accordingly, the position of the outlet 41*d* of the discharge port 141 is shifted in a counterclockwise direction in accordance with the arc of the control passage as it goes below. Further, the outlet 41*d* of the discharge port 141 becomes narrower as it goes toward above.

In a case of the aforementioned structure of the nozzle 40, the foam is discharged outside through the curved control passage so as to be discharged while swirling around the axis of the nozzle 40 (see the arrows shown in FIG. 13(C)). At the same time, it is moved upward by the force of the propellant, so that the foam discharged later is partially overlapped under the foam discharged previously, and a spiral shaped foam (soft cream shape) is obtained. When the spiral shaped foam is discharged, it hardly splashes around, and it is hardly attached and dripped around the nozzle 40, so that it is easily scooped by the palm of hand.

The nozzle 40 described above is thick as shown in FIG. 13(B), but it is easy to be bent at the part of the discharge port 141, so that it can be relatively easily crushed by fingers. It is also possible to partially make thinner or crease at the root part. Further, it is also possible to use soft crushable materials such as foaming body of, for example, polyethylene, polypropylene, elastomer, synthetic rubber, natural rubber or synthetic resin. When using the foaming body, it is preferable to provide a smooth skin on the inner surface and the outer surface.

The present invention is not limited to the aforementioned embodiments, and various modifications may be made within the scope of the present invention. For example, in the discharge member shown in FIGS. 6 to 8, the waviness parts (wave mountains 25*a* or valleys 25*b*) of the upper surface (pushing surface) of the pushing piece 25 are provided in equal intervals, but it is not necessary to be provided in equal intervals, so that it is possible to provide them irregularly. Further, it is not necessary to be the same width of the valleys 25*b* and the width of the mountains 25*b*, and the width of the valleys 25 may be larger or smaller than the width of the mountains 25*a*. Regarding the depth of the valleys 25*b* or the height of the mountains 25*a*, all of them do not have to be the same, and they may be different each other. Further, the pushing surface may be a shape along the shape of the back of fingers. In addition, instead of the pushing piece, it may be an operation piece which performs a pulling operation or a tilting operation.

Further, as the direction guide part of the discharge member 132 shown in FIGS. 12(A) to 12(C), it is not limited to the rib 34*c*, but it may be a plate shaped or a columnar shaped projection. Also, it may be a recess. For example, as shown in a dashed line in FIG. 12(B), the recesses 35*e* are provided at the portions where the joints of fingers are placed, so that the direction of inserting hand can be confirmed in advance. Further, the direction guide part may be applied to the pushing piece 25 of the discharge member 13 shown in FIGS. 6 to 8. In this case, it is possible to insert a hand in an ideal angle. Furthermore, the direction guide part may be provided in the nozzles 13, 30, 133 or the pushing piece 25 or the pushing part 135 instead of the shaft part 134. In addition, in FIG. 6, the aerosol product 100 is provided with the over-cap 17 or the shoulder cover 12, but they may not be necessarily provided.

Further, in the embodiment shown in FIG. 6, the nozzle 23 as a whole is formed by rubber, etc., but the mounting part 27 may be the hard synthetic resin, and it may be insert-molded by combining with the discharge part 26 which is made of rubber, elastomer, or soft resin. Further, as the pushing piece 25, a disk shape around the cylindrical body 22*a* is employed, but it may be possible to employ a plate piece which projects in a radial direction at approximately 1 to 4 sections.

Figure 14:
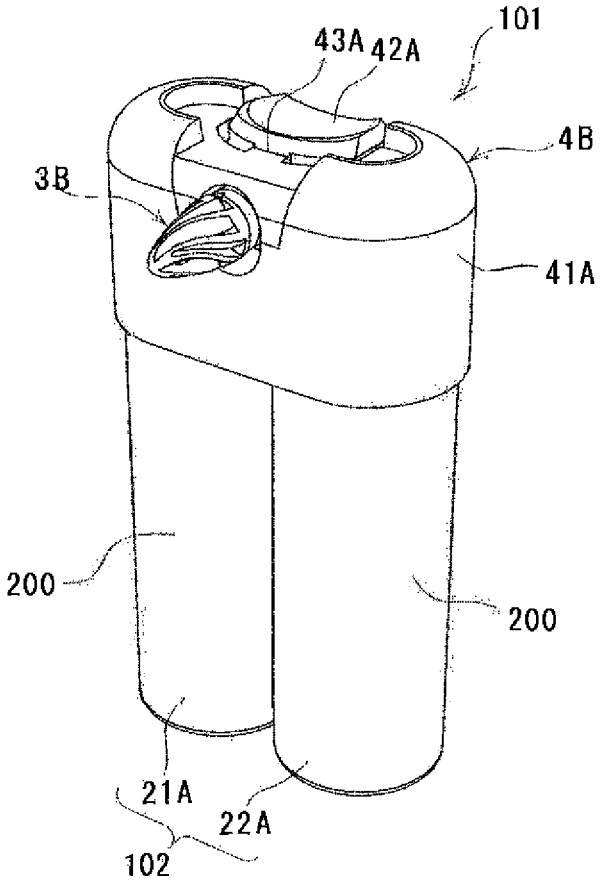
FIG. 14 is a perspective view showing a two-liquid discharge product according to one embodiment of the present invention.
Figure 15:
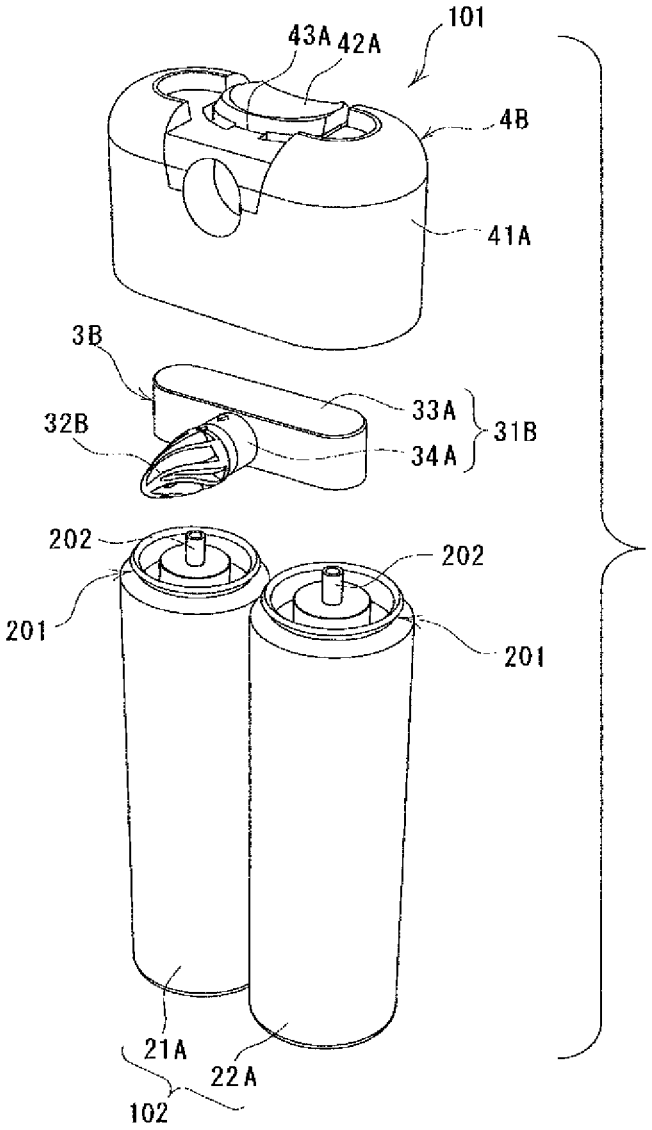
FIG. 15 is an exploded perspective view showing a two-liquid discharge product.

Next, an aerosol product described in FIGS. 14 to 21 will be described. FIGS. 14 to 21 relate to the aerosol product described in Japanese Patent Application No. 2018-077767. First, FIG. 14 will be described. The two-liquid discharge product (aerosol product) 101 shown in FIG. 14 is provided with a discharge container (aerosol container) 102, two types of concentrates C1, C2 filled in the discharge container 102 (see FIG. 20(B)), and two-liquid discharge nozzle 3B. Further, in this embodiment, as shown in FIGS. 14 and 15, an operation member 4B for operating the two-liquid discharge nozzle 3B is provided.

The discharge container 102 is configured with the first discharge container 21A in which the first concentrate C1 is filled, and the second discharge container 22A in which the second concentrate C2 is filled, and they are fixed each other in a parallel arrangement state by a binding member which is not shown.

In the discharge container 102, both of the first discharge container 21A and the second discharge container 22A are configured with bottomed cylindrical shaped container bodies 200 and valve assemblies 201 mounted to the opening parts provided at the upper end of the container bodies 200, and it is, so called, aerosol container. The container body 200 has pressure resistance capable of enduring the pressure of the propellant P filled inside in order to discharge the concentrates C1, C2. As the material, for example, it may be a metal such as aluminum, tin, etc., a synthetic resin such as polyethylene terephthalate, etc., a glass, etc., but it may be other materials. The valve assemblies 201 are publicly known to be provided with stems 202 which are used as a discharge port of the mixture of the concentrate and propellant P, stem rubbers 203 which cover the stem holes of the stems 202, housings 204 which slidably store the stems 202 in the axial direction, and a valve mechanism configured with a spring 205 energizing the stems 202 and maintaining the closure of the stem holes by the stem rubbers 203 when it is not operating, and a mountain cover 207 which mountains the valve mechanism 206 to the opening part of the container body 200 (see FIGS. 20(A) and 20(B)). However, it is not limited to this, and a different valve assembly structure may be used.

The concentrates C1, C2 filled in the discharge container 102 are, for example, two liquid reaction preparation, and one concentrate (the first concentrate C1) is filled in the first discharge container 21A, and the other concentrate (the second concentrate C2) is filled in the second discharge container 22A. When the concentrates C1, C2 are two liquid reaction type hair dyeing agents, for example, the first agent which includes dye (paraphenylenediamine, etc.) to color by oxidation is filled, and the second agent which includes oxidizing agent (hydrogen peroxide) to oxidize the dye is filled in the second discharge container 22A.

The propellant P filed in the discharge container 102 may be, for example, compressed gas such as nitrogen, carbon dioxide, air, liquified gas such as liquefied petroleum gas, dimethyl ether, hydrofluoroolefin, etc. However, it is not limited to this and various known propellant can be used.

In the discharge container 102 in which the concentrates C1, C2 and the propellant P are filled, closing the stem holes by the stem rubbers 203 are released by pushing the stems 202 (operating the stems 202), and the concentrates C1, C2 or the mixture of the concentrates and the propellant P are discharged from the stems 202.

Figure 16:
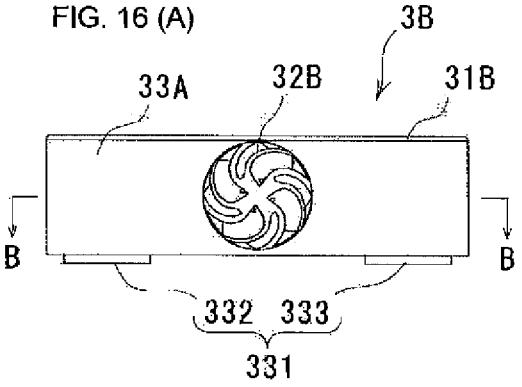
FIG. 16(A) is a front view showing a two-liquid discharge nozzle.
FIG. 16(B) is a plane view showing the two-liquid discharge nozzle.
FIG. 16(C) is a side view showing the two-liquid discharge nozzle.
FIG. 16(D) is a cross-sectional view taken along line A-A of the two-liquid discharge nozzle.
FIG. 16(E) is a cross-sectional view taken along line B-B of the two-liquid discharge nozzle.
FIG. 16(F) is a cross-sectional view taken along line C-C of the two-liquid discharge nozzle.
Figure 16:
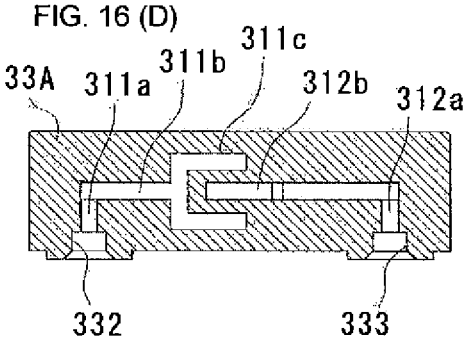
Figure 16:
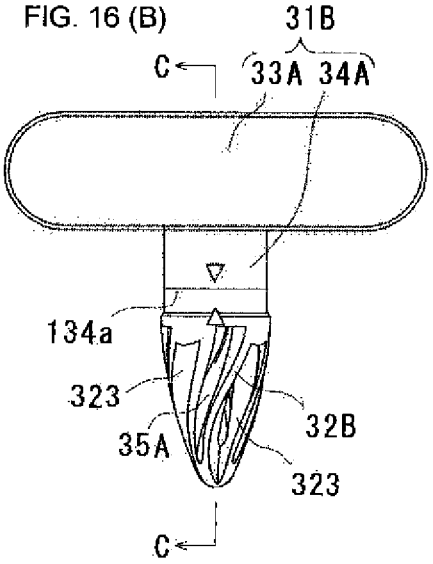
Figure 16:
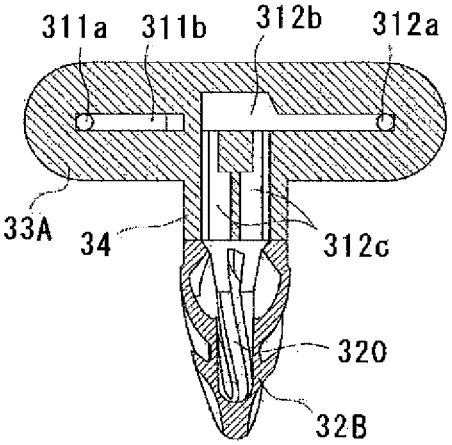
Figure 16:
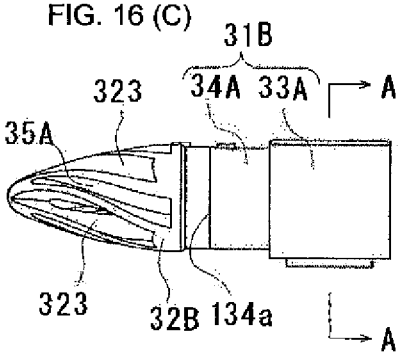
Figure 16:
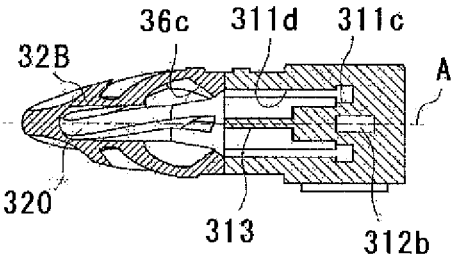
Figure 17:
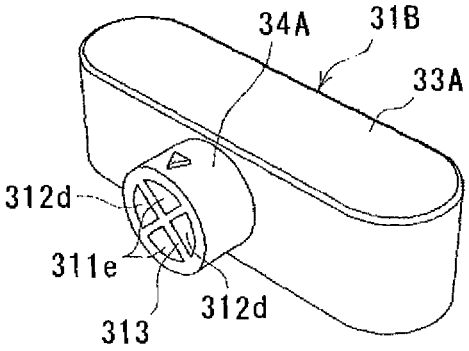
FIG. 17(A) is a perspective view of a body part of the two-liquid discharge nozzle.
FIG. 17(B) is a perspective view showing a passage inside the body part.
FIG. 17(C) is an exploded perspective view of FIG. 17(B).
Figure 17:
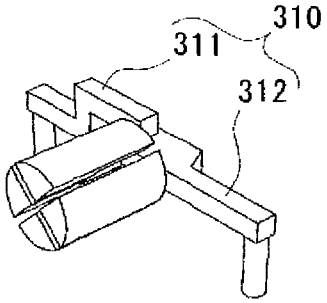
Figure 17:
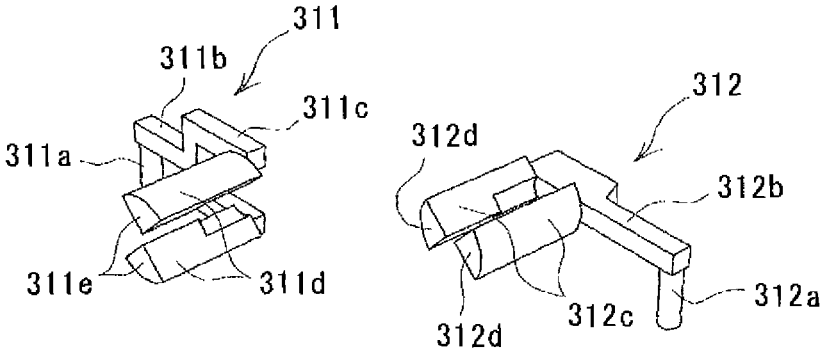

As shown in FIGS. 15 and 16, the two-liquid discharge nozzle 3B is provided with a nozzle part (discharging nozzle) 32B and a body part 31B connecting between the nozzle part 32B and the discharge container 102. First, the body part 31B will be described. The body part 31B is provided with a base 33A which has an elliptical shape in a plane view, and an extension part 34A extending in the horizontal direction from the center to the forward direction of the longitudinal direction of the base 33A. The base 33A has a length capable of being across the stem 202 of the first discharge container 21A and the stem 202 of the second discharge container 22A, and in the lower surface side, a stem mounting part 331 for mounting the stem 202 of the discharge container 102 is provided. The stem mounting part 331 is holes in which the stems 202 can be fitted, and it is configured with the first stem mounting part 332 in which the stem 202 of the first discharge container 21A is mounted, and the second stem mounting part 333 in which the stem 202 of the second discharge container 22A is mounted. The extension part 34A is an approximately columnar shape, and at its top end, a nozzle mounting part 134*a* for mounting the nozzle part 32B is provided.

As shown in FIGS. 16(D) to 16(F) and FIGS. 17(B) and 17(C), the body part 31B is provided with a passage 310 penetrating from the stem mounting part 331 to the nozzle mounting part 134*a*. The passage 310 is configured with the first passage 311 passing through the first concentrate C1, and the second passage 312 passing through the second concentrate C2. The first passage 311 and the second passage 312 are not connected and they are independent of each other. Accordingly, the first concentrate C1 and the second concentrate C2 are not mixed inside the body part 31B.

The first passage 311 is provided across the base 33A and the extension part 34A. In the first passage 311, the part located in the base 33A opens at the first stem mounting part 332, and it is configured with a vertical passage 311*a* extending upward from the first stem mounting part, a horizontal passage 311*b* extending in the right direction and the horizontal direction from the upper end of the vertical passage 311*a*, and a branch passage 311*c* in which the horizontal passage 311*b* is branched in the vertical direction. In the first passage 311, the part located in the extension part 34A is provided with two horizontal passages 311*d* extending in the axial direction of the extension part 34A. The two horizontal passages 311*d* are arranged in parallel in the vertical direction as shown in FIG. 17(C), and at the base end of the extension part 34A, each of these passages is connected to the branch passage 311*c* which is branched in the vertical direction.

Further, the second passage 312 is provided across between the base 33A and the extension part 34A. In the second passage 312, the second stem mounting part 333 opens at the part located in the base 33A, and it is provided with a vertical passage 312*a* extending upward from the second stem mounting part, and a horizontal passage 312*b* extending in the left direction in the horizontal direction (right and left direction) from the upper end of the vertical passage 312*a*. The horizontal passage 312*b* is located in between the branch passage 311*c* of the first passage 311. Further, it is widened to the rear side in the middle. In addition to the top end, an opening is provided at the middle part. In the second passage 312, the part located at the extension part 34A is provided with two horizontal passages 312*c* extending in the axial direction of the extension part 34A. The two horizontal passages 312*c* are arranged in the parallel direction as shown in FIG. 17(C), and each of the passages is connected to the opening of the horizontal passage 312*b* at the base end of the extension part 34A.

In the aforementioned structure of the body part 31B, at the tip end of the extension part 34A, two openings of the first passages 311 are arranged in the vertical direction, and two openings of the second passages 312 are arranged in the horizontal direction. In this state, it can be said that the opening 311*e* in the nozzle part 32B side of the first passage 311 and the opening 312*d* in the nozzle part 32B side of the second passage 312 are alternately arranged around the axis (around central axis A) of the nozzle part 32B by the cross shaped partition part 313 (see FIG. 17(A)). In the extension part 34A, the nozzle part 32B is mounted so as to communicate with each passage.

As shown in FIG. 18(B), the nozzle part 32B has an approximately bullet-shaped appearance pointing toward the top end. Further, as shown in FIGS. 18(A) and 18(C), the nozzle part 32B extends in the axial direction of the nozzle part 32B, and it is provided with an inner passage 320 in which the top end is closed, and a discharge port (opening part) 323 which opens at the inner passage 320 side (side surface of the nozzle part 32B).

The discharge ports 323 are a slit shape which is long in the axial direction of the nozzle part 32B, and these ports are provided four in equal intervals around the axis of the nozzle part 32B. Further, these ports are provided in a twisting manner around the axis of the nozzle part 32B. Specifically, these ports are twisted left-handed from the root to the top end of the nozzle part 32B. The discharge port 323 is provided with the first discharge port 324 and the second discharge port 325, and the first discharge port 324 and the second discharge port 325 are alternately arranged around the axis of the nozzle part 32B. Note that the first discharge port 324 is positioned on, mainly, the extension line of the horizontal passage 311*d* of the first passage 311. A recess positioned between the first discharge port 324 and the second discharge port 325 is the cut-off recessed part 35A and it does not communicate with the inner passage 320. The cut-off recessed part 35A may be omitted.

The opening inner peripheral surface 36A configuring the discharge port 323 is provided with a pair of side surface parts (side surface) 36*a*, 36*b* in which the upper ends are connected each other, and a lower surface part 36*c* connecting between the lower ends of the side surface parts 36*a*, 36*b*. When a boundary between the inner surface 320*a* configuring the inner passage 320 and the opening inner peripheral surface 36A is defined as the inlet 323*a* of the discharge port 323, and when a boundary between the outer surface 32*a* of the nozzle part 32B and the opening inner peripheral surface 36A is defined as the outlet 323*b* of the discharge port 323, the axal direction length L3 of the nozzle part 32B of the inlet 323*a* of the discharge port 323 is 3 to 50 mm, and preferably, it is 5 to 40 mm. Further, the width W1 of the inlet 323*a* is 0.3 to 3 mm, and preferably, it is 0.5 to 2 mm.

As shown in FIG. 18(C), a pair of side surface parts 36*a*, 36*b* is curved in an arc toward the outside from the central axis A of the nozzle part 32B. Specifically, each of the side surface parts 36*a*, 36*b* is curved in an arc toward the outlet 323*b* (the outer surface 32*a* of the nozzle part 32B: outer part) from the inlet 323*a* of the discharge port 323 (inner passage 320). Note that in this state, it can be said that each of the side surface parts 36*a*, 36*b* is curved around the axis of the nozzle part 32B. Each of the side surface parts 36*a*, 36*b* is curved in the same direction. Specifically, it is curved left-handed toward the outside from the central axis A of the nozzle part 32B. This is the same as the twisting direction in the axial direction of the nozzle part 32B of the discharge port 323. Further, all four discharge ports 323 are curved in the same direction. The curving degrees, that is, the degrees of curvature of the side surface parts 36*a*, 36*b*, differ each other among the pair of side surface parts 36*a*, 36*b*. Specifically, when comparing in the absolute value, the curvature degree of the side surface part (concave surface) 36*b* located in the outer periphery side of the curvature is larger than the curvature degree of the side surface part (convex surface) 36*a* located in the inner periphery side of the curvature (curvature radius is small). Further, a space between the pair of side surface parts 36*a*, 36*b* is expanded toward the outside. The width of the inner passage 320 almost does not change. On the other hand, the appearance of the nozzle part 32B is formed in a tapered shape. Accordingly, the horizontal direction length L2 of the control passage 37A formed by the pair of side surface parts 36*a*, 36*b* becomes shorter as it approaches toward the top end (upper side). The length L2 of the control passage 37A is 1 to 6 mm, and preferably, it is 2 to 5 mm.

As shown in FIG. 16(F), the lower surface part 36*c* is inclined with respect to the axial direction of the nozzle part 32B. Specifically, it is angled so as to open toward the top end of the nozzle part 32B.

As shown in FIG. 14, the operation member 4B is provided with a covering part 41A covering the two-liquid discharge nozzle 3B except the nozzle part 32B and the upper part of the discharge container 102, and a push button part 42A for operating the stems 202. The covering part 41A is a cylindrical member which is an approximately elliptical in the plane view. The upper end side is covered except the part where the push button part 42A is provided. On the other hand, the lower end side opens so as to be directly fixed to the discharge container 102 or indirectly fixed via a binding member (not shown) which binds the first discharge container 21A and the second discharge container 22A in the state that the two-liquid discharge nozzle 3B and the upper part of the discharge container 102 are enclosed. In the plane view, the push button part 42A is placed in the middle of the covering part 41A. The push button part 42A is connected to the covering part 41A via the hinge 43A.

In the two-liquid discharge product 101 of the aforementioned structure, when pushing the push button part 42A, the two-liquid discharge nozzle 3B placed in the lower side of the push button part 42A is pushed in, so that the stems 202 are pushed in. Then, the first concentrate C1 and the second concentrate C2 are respectfully injected from the discharge container 102, and are discharged outside through the passages provided inside the two-liquid discharge nozzle 3B. At this point, the opening 311*e* in the nozzle part 32B side of the first passage 311 and the opening 312*d* in the nozzle part 32B side of the second passage 312 are alternately arranged around the axis of the nozzle part 32B, so that the first concentrate C1 and the second concentrate C2 are mixed inside the inner passage 320, but mainly, the first concentrate C1 is discharged from the first discharge port 324, and mainly, the second concentrate C2 is discharged from the second discharge port 325. Further, the first discharge port 324 and the second discharge port 325 are alternately arranged around the nozzle part 32B, so that the first concentrate C1 and the second concentrate C2 are discharged in the state in which they are placed adjacent to each other. In addition, the pair of the side surface part 36*a*, 36*b* of the opening inner peripheral surface 36A is curved, and the discharge port 323 is twisted around the axis of the nozzle part 32B, so that these parts function as a swirling means R which swirls the concentrates C1, C2 around the axis of the nozzle part 32B, and the concentrates C1, C2 are discharged in a winding manner around the nozzle part 32B. As a result, while swirling the concentrates C1, C2 around the nozzle part 32B, the first concentrate C1 and the second concentrate C2 are alternately overlapped one after another, so that the laminated discharging object is obtained. Since the discharge port 323 is a slit-shape, the thickness of the layer is thin compared with the case of being discharged from a hole in a circular shape or a square shape. Accordingly, only stirring lightly, the first concentrate C1 and the second concentrate C2 can be easily mixed. Note that when swirling the discharging object around the nozzle part 32B in a certain amount, it is pushed by the discharging object discharged later so as to send it forward in the nozzle part 32. Accordingly, the discharging object becomes a soft cream shape.

Figure 19:
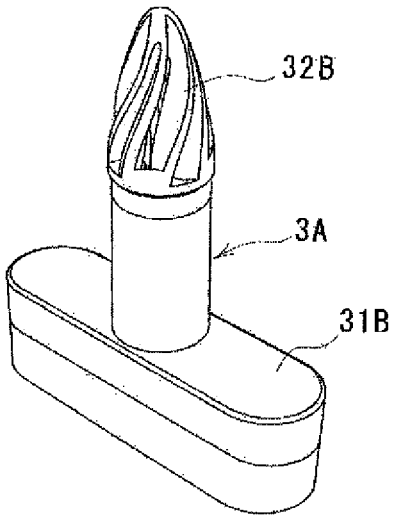
FIG. 19(A) is a perspective view showing a two-liquid discharge nozzle of another embodiment of the present invention.
FIG. 19(B) is a perspective view showing the two-liquid discharge product, which uses the two-liquid discharge nozzle, in a non-operation state.
FIG. 19(C) is a perspective view showing the two-liquid discharge product, which uses the two-liquid discharge nozzle, in an operation state.
Figure 19:
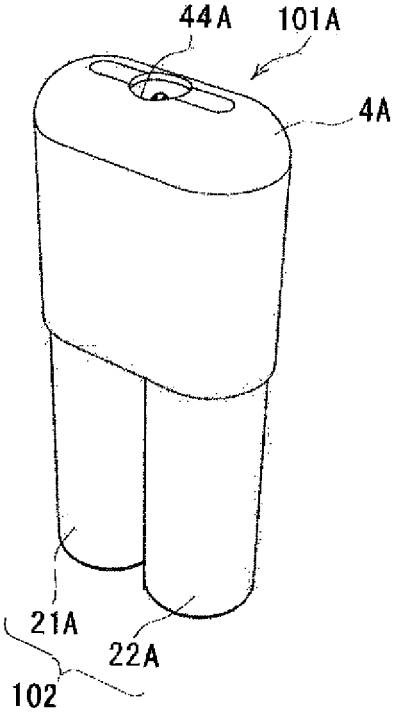
Figure 19:
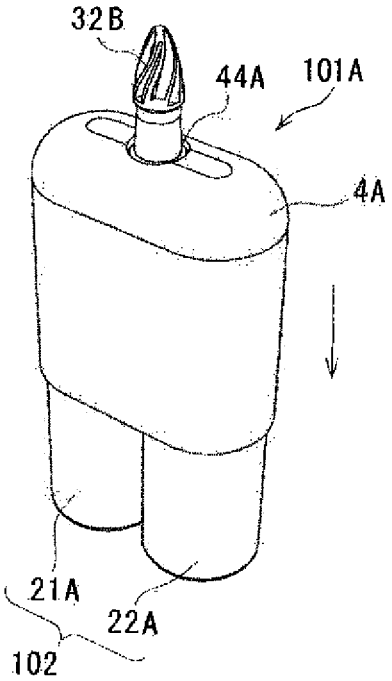

FIG. 19 shows another embodiment of the two-liquid discharge product (aerosol product) of the present invention. As shown in FIG. 19(A), the nozzle part 32B of the two-liquid discharge nozzle 3A is directed upward. Further, an operation member 4A is slidably mounted in the axial direction of the nozzle part 32B. The operation member 4A is energized to the upper side by an energizing means (not shown) such as a spring, etc., and when not operating, the nozzle part 32B is also stored inside the operation member 4A. When using, the operation member 4A is pushed in downwardly, and the nozzle part 32B is projected from the hole 44A provided on the upper surface. In this state, further, by pushing the operation member 4A in, the stems 202 are pushed via the two-liquid discharge nozzle 3A, and the concentrates C1, C2 are discharged. When stop performing the push operation, the operation member 4A is lifted up by the energizing means, and the nozzle part 32B is stored inside the operation member 4A again. With such structure, a hand is placed on the upper part of the operation member 4A, and the operation member 4A is pushed so as to project the nozzle part 32B between the fingers, and the concentrates C1, C2 are discharged on the upper side of a hand. Therefore, the discharging object can be scooped on the hand by only pulling the hand upwardly. Accordingly, it is possible to use it by a single hand, and it is not necessary to lift up the two-liquid discharge product 101A when it is used. Regarding another structure, it is the same structure as the aforementioned two-liquid discharge product 101, so that the same reference numerals are applied and the detailed descriptions are omitted.

Figure 20:
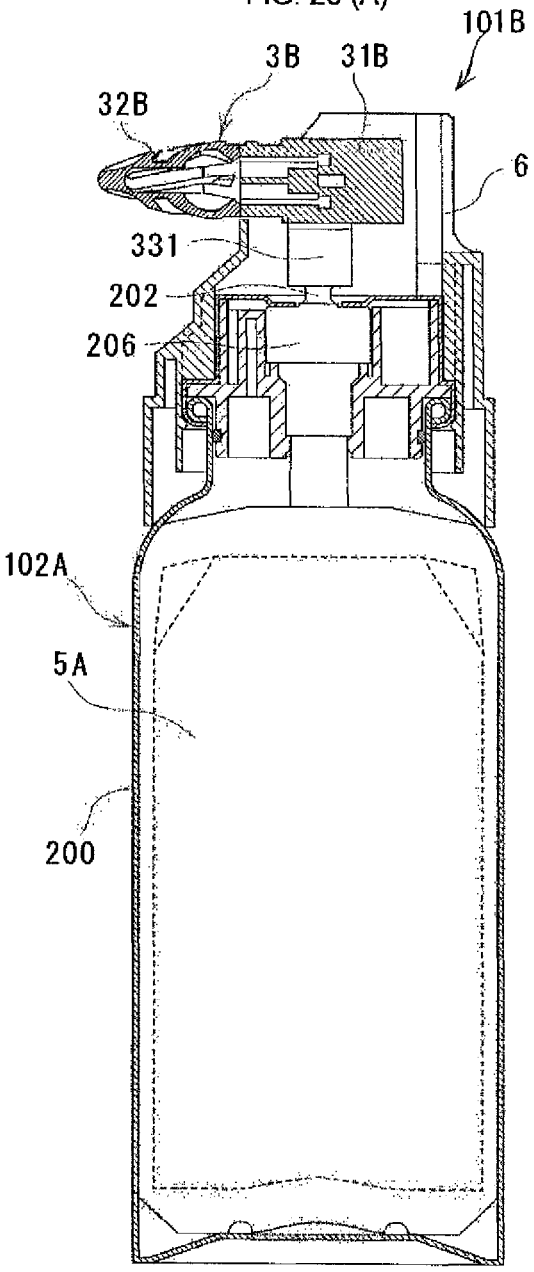
FIG. 20(A) is a cross-sectional view showing a two-liquid discharge product of still another embodiment of the present invention.
FIG. 20(B) is a cross-sectional view showing the discharge container of FIG. 20(A).
Figure 20:
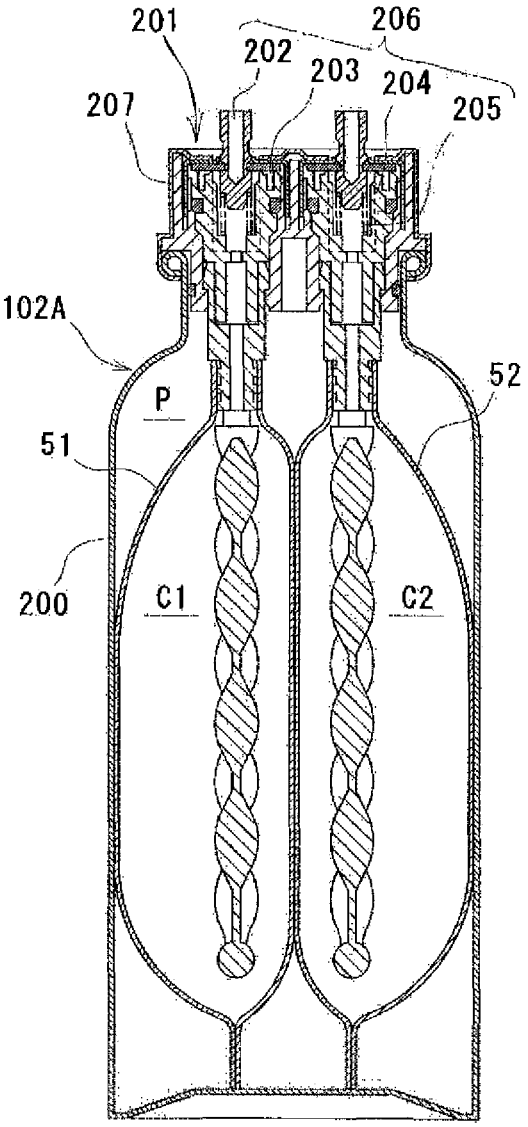

FIG. 20 shows still another embodiment of the two-liquid discharge product (aerosol product) of the present invention. In the two-liquid discharge product 101B of this embodiment, two inner bags 5A are provided inside one container body 200, and one discharge container (aerosol product) 102A has two stems 202, 202. The inner bags 5 has flexibility, for example, pouch, and the first concentrate C1 is filled in one of the inner bags 51, and the second concentrate C2 is filled in the other one of the inner bags 52. The propellant P is filled between the container body 200 and the inner bags 5. In the case of such structure, the concentrates C1, C2 and the propellant P are not mixed, so that the concentrates C1, C2 itself can be discharged. That is, when the concentrates C1, C2 are a cream state, it is possible to discharge and remain it in the cream state. Note that although the concentrates C1, C2 are the cream state, if it is discharged in a mixed state with the propellant P, it easily becomes a foam state.

Further, in this embodiment, the operation members 4B, 4A are not provided, so that the two-liquid discharge nozzle 3B is directly pushed in. Reference numeral 6 denotes a shoulder cover. Regarding another structure, it is the same as the aforementioned two-liquid discharge product 101, so that the same reference numerals are applied, and the detailed descriptions are omitted.

Figure 18:
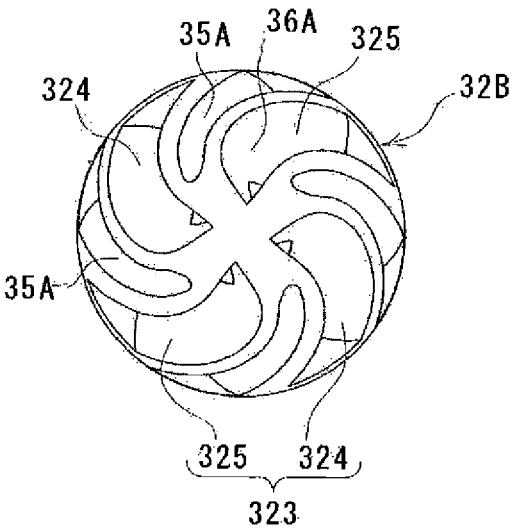
FIG. 18(A) is a front view showing the nozzle part.
FIG. 18(B) is a side surface view showing the nozzle part.
FIG. 18(C) is a cross-sectional view taken along line D-D of the nozzle part.
Figure 18:
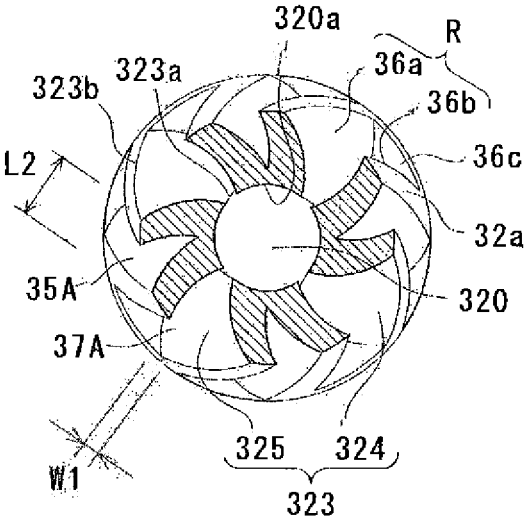
Figure 18:
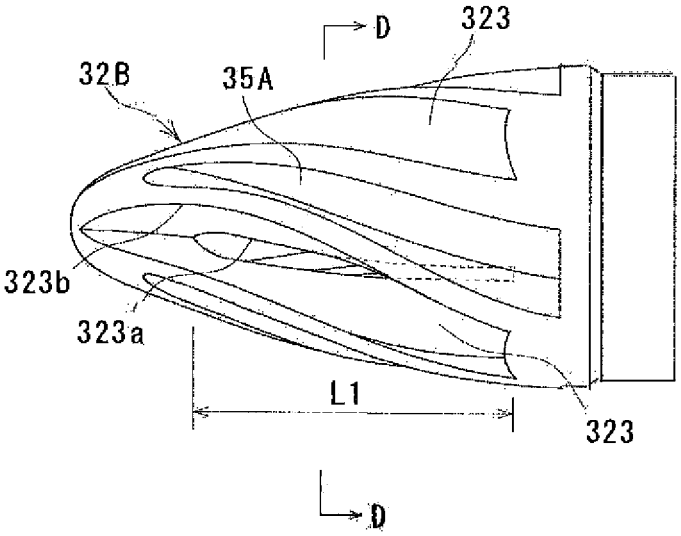
Figure 21:
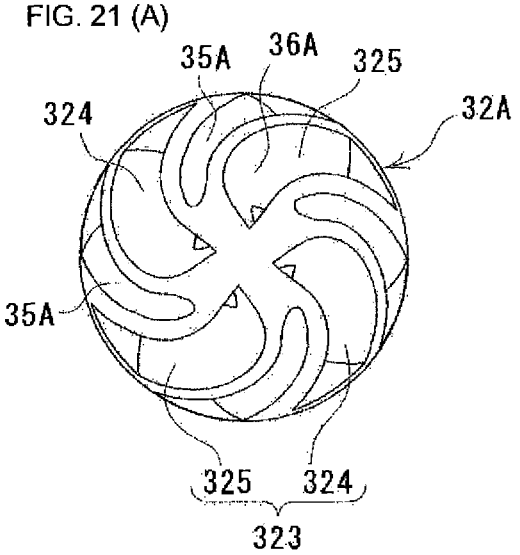
FIG. 21(A) is a front view showing another nozzle part.
FIG. 21(B) is a side surface view showing the nozzle part.
FIG. 21(C) is a cross-sectional view taken along line E-E of the nozzle part.
Figure 21:
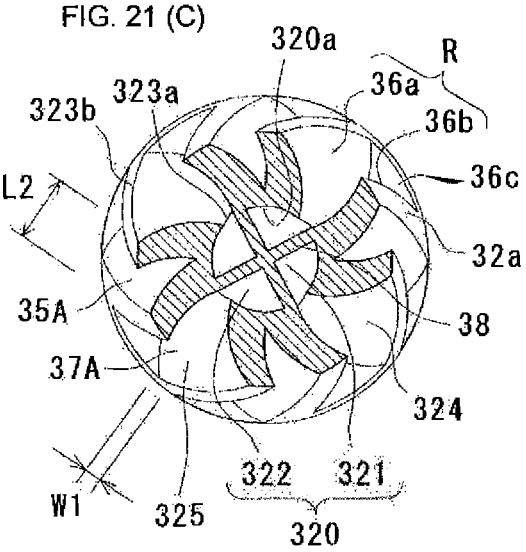
Figure 21:
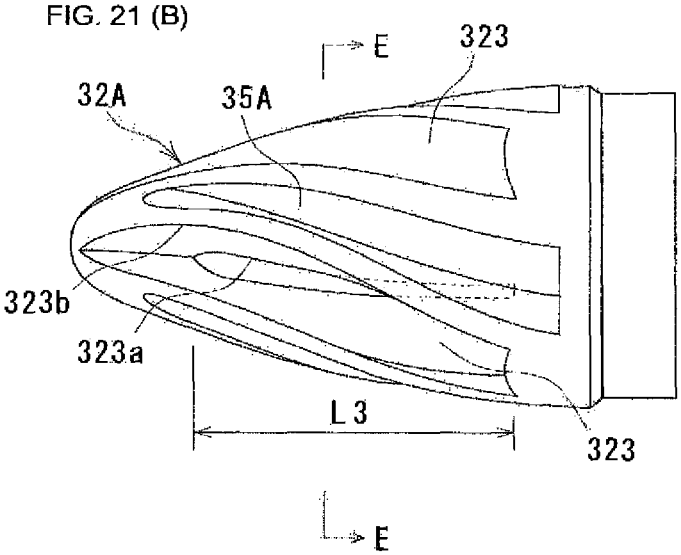

FIG. 21 shows a nozzle part (discharging nozzle) 32A of the structure which is different from the aforementioned nozzle part 32B. In the nozzle part 32A, an inner passage 320 is partitioned by a cross-shaped partition part 38, and it is provided with the first inner passage 321 which communicates with the first passage 311 of the body part 31B, and the second inner passage 322 which communicates with the second passage 312. The first inner passage 321 and the second inner passage 322 are provided two each, and when viewed from the top end of the nozzle part 32A, they are alternately arranged in the peripheral direction (see FIG. 21(C)). These inner passages 321, 322 are not connected and independently provided. Accordingly, the first concentrate C1 and the second concentrate C2 are not mixed inside the nozzle part 32A, the first concentrate C1 passing through the first inner passage 321 is discharged from the first discharge port 324 and the second concentrate C2 passing through the second inner passage 322 is discharged from the second discharge port 325. As shown in FIG. 18, it is possible to use the nozzle part 32A in place of the nozzle part 32B. Note that in the nozzle part 32B shown in FIG. 18, the first concentrate C1 and the second concentrate C2 are mixed in the inner passage 320, so that the difference in the flow velocity of each of the concentrates C1, C2 is corrected. Therefore, at the time of discharging, it tends to suppress scattering of the concentrates C1, C2. Regarding the nozzle part 32A, the concentrates C1, C2 are not mixed each other inside the two-liquid discharge nozzle 3B, so that the reactant does not remain inside and it can reduce the labor necessary for cleaning after use.

The present invention is not limited to the aforementioned embodiments, and various modifications may be made within the scope of the present invention. For example, in the aforementioned embodiments, two structures (the structure in which a pair of side surface parts 36*a*, 36*b* of the opening inner peripheral surface 36A is curved in an arc toward the outside from the central axis A of the nozzle parts 32B, 32A, the structure in which the discharge port 323 is twisted around the axis of the nozzle parts 32B, 32A) are employed as the swirling means R, but one of these structures may be employed. Further, among the pair of side surface parts 36*a*, 36*b* of the opening inner peripheral surface 36A, any one of them may be curved. As the swirling means R, other than that, at the outside of the discharge port 323, a wing is provided in the manner in which the side surface parts 36*a*, 36*b* of the opening inner peripheral surface 36A extend, and it is possible to make the wing to be curved or to be twisted around the axis of the nozzle part 32B. It is possible to increase and reduce the number of the discharge port 323 or the openings 311*e*, 312*d*, so that it is not limited to the aforementioned embodiments. However, it is preferable to match the number or the arrangement position (position angle) between the openings 311*e*, 312*d* and the first and second discharge ports 324, 325. For example, in the aforementioned embodiments, the openings 311*e*, 312*d* and the discharge ports 323 are provided four each, and these are arranged every 90 degrees, but six of them may be provided, and these are arranged every 60 degrees.

As the concentrates C1, C2, it is not limited to the two liquid reaction preparation, but various things can be used. For example, when the color of the first concentrate C1 and the second concentrate C2 is different, a strip appearance is obtained. One of them is discharged in a foam state, and the other one is discharged in a liquid state (cream state), etc., so that it may be different in a discharged state.

Effect of the Invention

The discharge nozzle of the present invention is provided with an inner passage extending in the axial direction of the discharge nozzle, a closing part closing the top end of the inner passage, and an opening part opening in the side of the inner passage. Therefore, the foam supplied from the aerosol container proceeds in the axial direction of the discharging nozzle through the inner passage and the proceeding direction is changed to the side by the closing part, and the foam is discharged outside from the opening part, so that any movement can be given to the foam at the time of discharging. Further, when the opening inner peripheral surface configuring the opening part is provided with the pair of side surfaces, the foamable contents derived from the aerosol container and/or the foamable contents after foaming (hereinafter simply referred to as foam) flows toward the opening part, which opens to the side of the inner passage, by the closing part which closes the top end of the inner passage, and it is discharged along the pair of side surfaces of the opening inner peripheral surface of the opening part, so that any movement can be given to the foam at the time of discharging.

Further, when the side surface is formed in an arc toward outside from the inner passage, the foam is discharged while swirling. Further, the length (control distance) in which the foam direction can be controlled becomes longer compared with the case in which the side surface is straight, so that the foam discharging direction is easily controlled. Further, when the control distance is not changed, the thickness of the discharging nozzle can be thinner, so that it is possible to miniaturize the discharging nozzle. Each of the side surfaces is formed in an arc toward outside from the inner passage, and when each surface is curved in the same direction, the foam can be discharged while surely swirling. Among the side surfaces, when the curvature degree of the side surface positioned at the outer peripheral side in the curve is larger than the curvature degree of the side surface positioned at the inner peripheral side in the curve, the foam can be discharged while swirling in a winding manner around the outer peripheral surface of the discharging nozzle. Therefore, after discharging, the foam is not easily flowed down from the discharging nozzle.

When a space between the side surfaces expands outwardly, the foam can be smoothly discharged. When the opening part opens in an elevation angle, the foam is discharged upwardly, so that the lower portion of the foam discharged first and the upper portion of the foam discharged later are partially overlapped, and it is formed in a soft cream shape. When the opening part is twisted around the axis of a discharge nozzle, the foam is swirled more easily.

If the appearance of the discharge nozzle is an approximately conical shape, the foam adhered around the discharge nozzle is easily scooped. If the shape of the opening is an inverse triangular shape, the foam is supported by the side surfaces which become close to each other as it goes down, so that the foam is easily held around the discharge nozzle. Also, when the appearance of the discharge nozzle is an approximately bullet-shape, the foam is easily held around the discharge nozzle.

The terms and descriptions used herein are used only for explanatory purposes and the present invention is not limited to them. Accordingly, the present invention allows various design-changes falling within the claimed scope of the present invention.

While the present invention may be embodied in many different forms, a number of illustrative embodiments are described herein with the understanding that the present disclosure is to be considered as providing examples of the principles of the invention and such examples are not intended to limit the invention to preferred embodiments described herein and/or illustrated herein.

While illustrative embodiments of the invention have been described herein, the present invention is not limited to the various preferred embodiments described herein, but includes any and all embodiments having equivalent elements, modifications, omissions, combinations (e.g., of aspects across various embodiments), adaptations and/or alterations as would be appreciated by those in the art based on the present disclosure. The limitations in the claims are to be interpreted broadly based on the language employed in the claims and not limited to examples described in the present specification or during the prosecution of the application, which examples are to be construed as non-exclusive. For example, in the present disclosure, the term "preferably" is non-exclusive and means "preferably, but not limited to." In this disclosure and during the prosecution of this application, the terminology "present invention" or "invention" is meant as a non-specific, general reference and may be used as a reference to one or more aspects within the present disclosure. The language present invention or invention should not be improperly interpreted as an identification of criticality, should not be improperly interpreted as applying across all aspects or embodiments (i.e., it should be understood that the present invention has a number of aspects and embodiments), and should not be improperly interpreted as limiting the scope of the application or claims. In this disclosure and during the prosecution of this application, the terminology "embodiment" can be used to describe any aspect, feature, process or step, any combination thereof, and/or any portion thereof, etc. In some examples, various embodiments may include overlapping features.

The invention claimed is:

1. A foamable contents discharging nozzle which is a discharging nozzle mounted on an aerosol container in which foamable contents are filled, comprising:

an inner passage extending in an axial direction of the discharging nozzle;

a closing part closing a top end of the discharging nozzle;

an opening part opening one side of the inner passage; and an opening inner peripheral surface configuring the opening part which is provided with a pair of side surfaces controlling a discharging direction of the foamable contents discharged outside through the opening part from the inner passage, wherein each of the pair of side surfaces is curved in an arc toward outside from the inner passage, and each arc is curved in a same direction, and wherein among the pair of side surfaces, a curvature degree of a side surface positioned at an outer peripheral side in a curve is larger than a curvature degree of a side surface positioned at an inner peripheral side in a curve.

2. The foamable contents discharging nozzle according to claim 1, wherein the opening part opens in an elevation angle.

3. The foamable contents discharging nozzle according to claim 1, wherein the opening part is twisted around an axis of the discharge nozzle.

4. The foamable contents discharging nozzle according to claim 1, wherein an appearance of the discharging nozzle is an approximately bullet-shape.

5. An aerosol product comprising:

an aerosol container;

a foamable contents filled in the aerosol container; and a discharging nozzle according to claim 1 provided in the aerosol container.

6. A foamable contents discharging nozzle which is a discharging nozzle mounted on an aerosol container in which foamable contents are filled, comprising:

an inner passage extending in an axial direction of the discharging nozzle;

a closing part closing a top end of the discharging nozzle;

an opening part opening one side of the inner passage; and an opening inner peripheral surface configuring the opening part which is provided with a pair of side surfaces controlling a discharging direction of the foamable contents discharged outside through the opening part from the inner passage, wherein a space between the side surfaces expands outwardly.

7. The foamable contents discharging nozzle according to claim 6, wherein the opening part opens in an elevation angle.

8. The foamable contents discharging nozzle according to claim 6, wherein the opening part is twisted around an axis of the discharge nozzle.

9. The foamable contents discharging nozzle according to claim 6, wherein an appearance of the discharging nozzle is an approximately bullet-shape.

10. An aerosol product comprising:

an aerosol container;

a foamable contents filled in the aerosol container; and a discharging nozzle according to claim 6 provided in the aerosol container.

11. A foamable contents discharging nozzle which is a discharging nozzle mounted on an aerosol container in which foamable contents are filled, comprising:

an inner passage extending in an axial direction of the discharging nozzle;

a closing part closing a top end of the discharging nozzle;

an opening part opening one side of the inner passage; and an opening inner peripheral surface configuring the opening part which is provided with a pair of side surfaces controlling a discharging direction of the foamable contents discharged outside through the opening part from the inner passage, wherein the opening part is twisted around an axis of the discharge nozzle.

12. The foamable contents discharging nozzle according to claim 11, wherein an appearance of the discharging nozzle is an approximately bullet-shape.

13. An aerosol product comprising:

an aerosol container;

a foamable contents filled in the aerosol container; and a discharging nozzle according to claim 11 provided in the aerosol container.

14. The foamable contents discharging nozzle according to claim 11, wherein each of the pair of side surfaces is curved in an arc toward outside from the inner passage, and each arc is curved in a same direction.

15. The foamable contents discharging nozzle according to claim 11, wherein the opening part opens in an elevation angle.

16. A foamable contents discharging nozzle which is a discharging nozzle mounted on an aerosol container in which foamable contents are filled, comprising:

an inner passage extending in an axial direction of the discharging nozzle;

a closing part closing a top end of the discharging nozzle; and an opening part opening one side of the inner passage, wherein an appearance of the discharge nozzle is an inverse conical shape, and a part of the discharging nozzle where the opening part is provided increases in diameter toward the top end of the discharging nozzle.

17. The foamable contents discharging nozzle according to claim 16, wherein a shape of the opening part is an inverse triangular shape.

18. An aerosol product comprising:

an aerosol container;

a foamable contents filled in the aerosol container; and a discharging nozzle according to claim 16 provided in the aerosol container.

19. A foamable contents discharging nozzle which is a discharging nozzle mounted on an aerosol container in which foamable contents are filled, comprising:

an inner passage extending in an axial direction of the discharging nozzle;

a closing part closing a top end of the discharging nozzle; and an opening part opening one side of the inner passage wherein a shape of the opening part is an inverse triangular shape when the opening part is viewed from outside of the discharging nozzle.

20. An aerosol product comprising:

an aerosol container;

a foamable contents filled in the aerosol container; and a discharging nozzle according to claim 19 provided in the aerosol container.

* * * * *